US005368310A

United States Patent [19]

Ogata et al.

[11] Patent Number: 5,368,310

[45] Date of Patent: Nov. 29, 1994

[54] SHOVEL TYPE GAME MACHINE

[75] Inventors: Mitsuru Ogata, Kawasaki; Hiroyuki Kobayashi, Tokyo; Toshitake Inagaki, Sagamihara; Takashi Masuko, Kawaguchi; Hiroshi Takeuchi, Tokyo, all of Japan

[73] Assignee: Namco Ltd., Tokyo, Japan

[21] Appl. No.: 46,175

[22] Filed: Apr. 14, 1993

[30] Foreign Application Priority Data

Apr. 16, 1992 [JP] Japan ..... 4-124346

[51] Int. Cl.[5] ..... A63F 9/00

[52] U.S. Cl. ..... 273/448

[58] Field of Search ..... 273/440, 441, 447, 448

[56] References Cited

U.S. PATENT DOCUMENTS

| | | | |
|---|---|---|---|
| 3,572,703 | 3/1971 | Greene | 273/448 |
| 4,684,128 | 8/1987 | Verstraeten | 273/448 |
| 4,685,673 | 8/1987 | Verstraeten | 273/448 |
| 4,718,667 | 1/1988 | Shoemaker, Jr. | 273/448 |
| 5,007,636 | 4/1991 | Pagani | 273/448 |
| 5,271,628 | 12/1993 | Okada | 273/448 |

FOREIGN PATENT DOCUMENTS

| | | |
|---|---|---|
| 62-157593 | 10/1987 | Japan . |
| 2-51594 | 4/1990 | Japan . |
| 3-21376 | 3/1991 | Japan . |

*Primary Examiner*—William H. Grieb
*Attorney, Agent, or Firm*—Oliff & Berridge

[57] ABSTRACT

A shovel type game machine is adapted to pick up articles on a display platform. The game machine has a resiliently deformable bucket, and a bucket drive device for supporting the top of the bucket for tilting movement. The bucket drive device causes the bucket to perform its shoveling operation while tilting the bucket forwardly with a given force. The shoveling operation is performed by moving the pivot center of the bucket downwardly. Thus, the bucket can be resiliently deformed to move its tip below the articles.

34 Claims, 23 Drawing Sheets

SHOVEL TYPE GAME MACHINE

BACKGROUND OF THE INVENTION

1. Field of the Invention

The present invention relates to an improved shovel type game machine that is played to pick up articles on a display platform.

1. Description or the Related Arts

There is known a game machine which picks up articles on a display platform and takes out the picked-up articles through an article gaining port. Game machines of such a type are disclosed in Japanese Utility-Model Laid-Open No. Sho 62-157593 and Japanese Utility-Model Laid-Open No. Hei 2-51594.

Such game machines are known as crane type game machines and generally comprises an article picking-up shovel formed into a crane shape and an article gaining port for removing the articles. When a player manipulates a crane operating button, the crane is moved to pick up articles with a shovel formed at the tip of the crane. The picked-up articles can be removed through the gaining port.

However, the game machines of the prior art are difficult to pick up articles with the crane, resulting in reduction of the amusingness in the game.

Particularly, when articles successively conveyed along a conveyance path are picked up by the crane, picking up articles after fails because articles are scattered on the conveyance path. This also results in reduction of the amusingness in the crane game.

SUMMARY OF THE INVENTION

It is therefore an object of the present invention to provide a shovel type game machine which can securely pick up articles without problem from the position and scatter or articles on a display platform.

To this end, the present invention provides a shovel type game machine comprising a display platform and shovel arm means for picking up articles on the display platform, said shovel arm means comprising a resiliently deformable bucket For picking up the articles and bucket drive means for pivotally supporting said bucket and for tilting said bucket forwardly with a given force, thereby causing said bucket to perform a shoveling operation for picking up said articles, said bucket drive means being adapted to make said shoveling operation by moving the pivot center of said bucket downwardly, whereby said bucket can be resiliently deformed to move its tip below said articles.

The present invention also provides a shovel type game machine comprising a display platform and shovel arm means for picking up articles on the display platform, said shovel arm means comprising a resiliently deformable bucket for picking up the articles and bucket drive means for pivotally supporting said bucket and for tilting said bucket forwardly in a direction perpendicular to the direction of conveyance with a given force, thereby causing said bucket to perform a shoveling operation for picking up said articles, said bucket drive means being adapted to make said shoveling operation by moving the pivot center of said bucket downwardly, whereby said bucket can be resiliently deformed to move its tip below said articles.

The bucket drive means comprises a bucket tilting drive for pivotally supporting the bucket, a bucket elevating drive for moving the bucket tilting drive in the vertical direction to draw a given locus, and a drive control section for stopping the downward movement of said bucket elevating drive before the lowest position of said bucket and then initiating said shoveling operation while causing said bucket tilting drive to tilt said bucket forwardly with said force and thereafter for re-initiating the downward movement of said bucket tilting drive to move the tip of said bucket below the articles while resiliently deforming said bucket.

According to the present invention, the shoveling operation for causing the bucket to pick up the articles with a given force, for example, elastic force, can be carried out by moving the pivot center of the bucket downwardly while maintaining the bucket tilted.

Even if the articles cannot be picked up by engagement of the bucket tip with the side of an article during the shoveling operation, therefore, the bucket can be resiliently deformed to move its tip below the article as the pivot center of the bucket is moved downwardly. This causes the bucket to securely pick up the article. The present invention is particularly very suitable for use in such a game machine that the articles being conveyed on the display platform are picked up by the bucket. Even when the articles are broadly dispersed over the conveyance path and difficult to be picked up by the bucket due to engagement of the bucket tip with the side of any one of the articles as in the prior art, the present invention can securely pick up the articles. This can greatly improve the amusingness in the crane game.

DETAILED DESCRIPTION OF THE PREFERRED EMBODIMENTS

Figure 1:
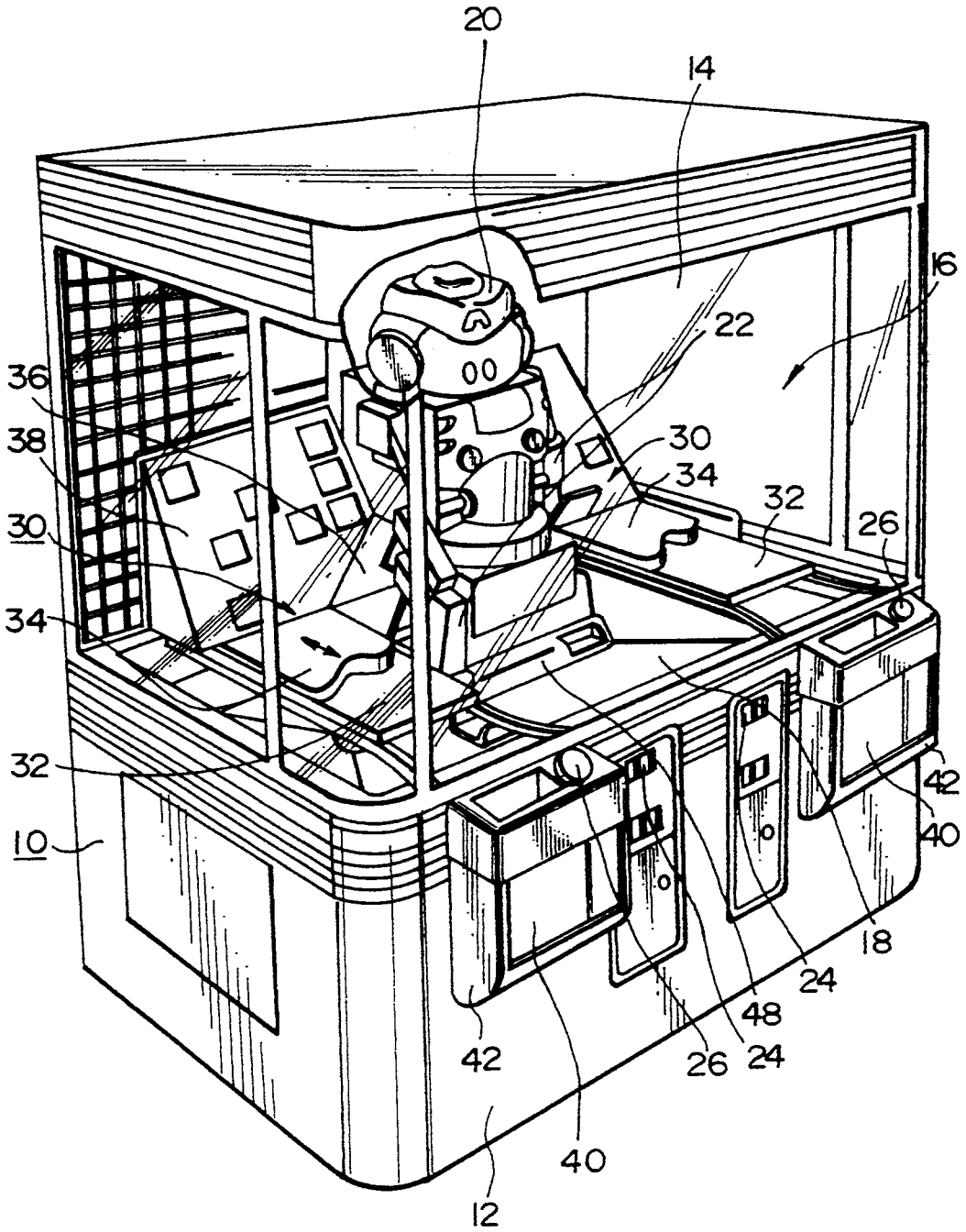
FIG. 1 is a schematic and perspective view of the entire arrangement of a game machine to which the present invention is applied.

Referring to FIG. 1, there is shown a shovel type game machine to which the present invention is applied. The game machine comprises a transversely extending housing 10, the lower half of which defines an opaque housing body 12. The top of the housing body 12 supports transparent front and side windows which form a display space 16.

A transversely extending partition platform 48 is centrally located on the top of the housing body 12 within the display space 16. The partition platform 48 supports a shovel robot 20 which faces the front of the housing body 12.

The partition platform 48 is surrounded by a substantially rectangular conveyance platform 18 extending in the transverse direction. The conveyance platform 18 is used to convey various articles such as stuffed dolls, chocolates and so on, in the endless manner. A player can observe the conveyance of the articles through the transparent windows 14.

The shovel robot 20 includes a pair of shovel arms 22 mounted thereon at the opposite sides. Each of the shovel arms 22 is used to pick up the articles which are bring conveyed on the conveyance platform 18.

An articles taking-out mechanism 30 is located within the display space 16 at an outward position adjacent to each of the shovel arms 22. Each of the articles taking-out mechanisms 30 is adapted to move an article picked up by the shovel arm 22 to a taking-out port 40 formed on the side of the housing body 12 on a given condition.

Each of the taking-out mechanisms 30 includes a fixed table 32, a slide table 34 and a sloping plate 36. The fixed table 32 is disposed to extend toward the taking-out port 40 while the slide table 34 is reciprocated on the Fixed table 32 away from and toward the taking-out port 40 within a given extent. If the article Falls down from the shovel arm 22, it is conducted onto the slide table 34 through the sloping plate 36. The article will be reciprocated by the movement of the slide table 34.

A back wall 38 is located backwardly of the taking-out mechanism 30 and functions to urge the article forwardly. When the slide table 34 moves toward the back wall 38, the slide table 34 will not be resisted, but the article on the slide table 34 is prevented from further moving by the back wall 38. As a result, the article will be moved to the forward end of the slide table 34 by the back wall 38. Such a function is repeated as the articles are successively conveyed onto the slide table 34 by the shovel arms 22. Thus, the first article on the slide table 34 is gradually urged forwardly and finally falls from the slide table 34 onto the fixed table 32. The article fallen on the fixed table 32 is then fallen from the forward end of the fixed table 32 into the taking-out port 40 through the forward movement of the slide table 34.

Figure 3:
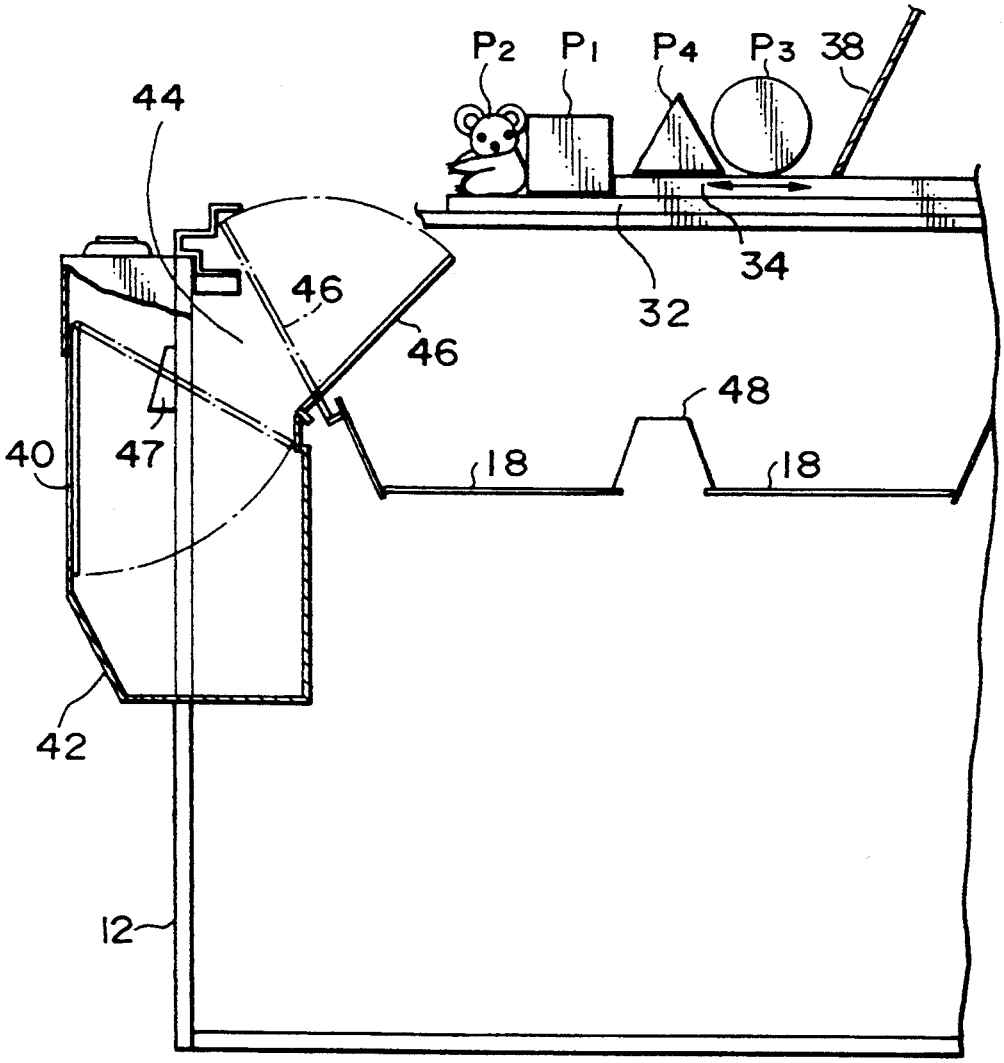
FIG. 3 is a schematic and cross-sectional view of the articles taking-out mechanism and articles taking-out housing portion in the game machine of FIG. 1.

FIG. 3 is a schematic cross-section of that portion of the game machine which is located between the article taking-out mechanism 30 and the article taking-out port 40. The taking-out port 40 is formed in the front side of an article taking-out housing 42 which is provided in the front side of the housing body 12. The article taking-out port 40 communicates with an article gaining port 44 which is formed in the housing body 12 above the taking-out housing 40 and directed to the fixed table 32. The article gaining port 44 is normally closed by a lid plate 46 which prevents articles P from falling from the fixed table 32 into the taking-out housing 42.

The lid plate 46 is pivotally connected to the housing body 12 adjacent to the lower end of the lid plate 46. More particularly, the lid plate 46 is pivotable between a close position in which the article gaining port 44 is closed by the lid plate 46 as shown by alternate long and short dash line in FIG. 3 and an open position in which the lid plate 46 is opened to serve as an article guide leading to the fixed table 32 as shown by solid line in FIG. 3.

When the game is initiated by a player, the lid plate 46 is pivoted from its close position to its open position by a drive (not shown). In the open position, the lid plate 46 functions as a guide plate for conducting the articles P fallen from the forward end of the fixed table 32 into the taking-out housing 42. If the player intentionally oscillates the housing 10 to fall the articles P from the fixed table 32 into the taking-out housing 42, it is sensed by an oscillation sensor 47 which is located within the taking-out housing 42. The oscillation sensor 47 then generates a signal that is used to forcedly move the lid plate 46 from its open position to its close position. As a result, the article gaining port 44 will be closed to prevent the unfair practice.

At the end of the game, the lid plate 46 is similarly pivoted from its open position to its close position to close the article gaining port 44.

When a coin is thrown into a coin slot 24, the game is initiated and the lid plate 46 is pivoted from its close position to its open position. The player can manipulate the button 26 while viewing the articles that are being conveyed on the conveyance platform 18. Thus, a shovel arm 22 is actuated to pick up the articles. If an article is successfully picked up by the shovel arm 22, that article is then fallen onto the sloping plate 36 and moves onto the slide table 34 through the sloping plate 36. As described, the article is urged forwardly by the taking-out mechanism 30 and then fallen into the taking-out housing 42 through the slide table 34, fixed table 32 and lid plate 46. In such a manner, the player may take out the articles conveyed on the conveyance platform 18.

The conveyance platform is located within the display space 16 on the housing body 12 will now be described in detail.

Figure 4:
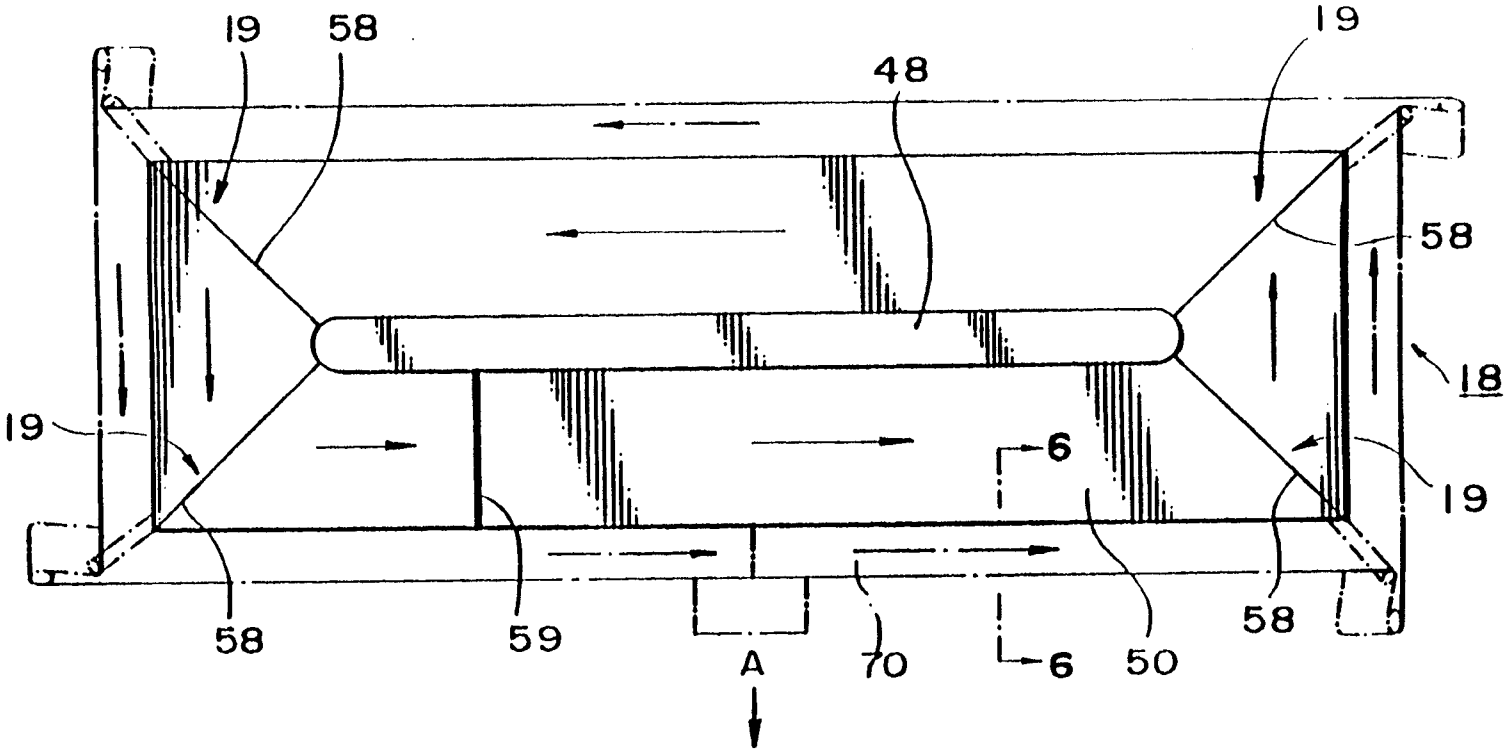
FIG. 4 is a plan view of a main conveyor belt usable in one embodiment of a game machine constructed in accordance with the present invention.
Figure 5:
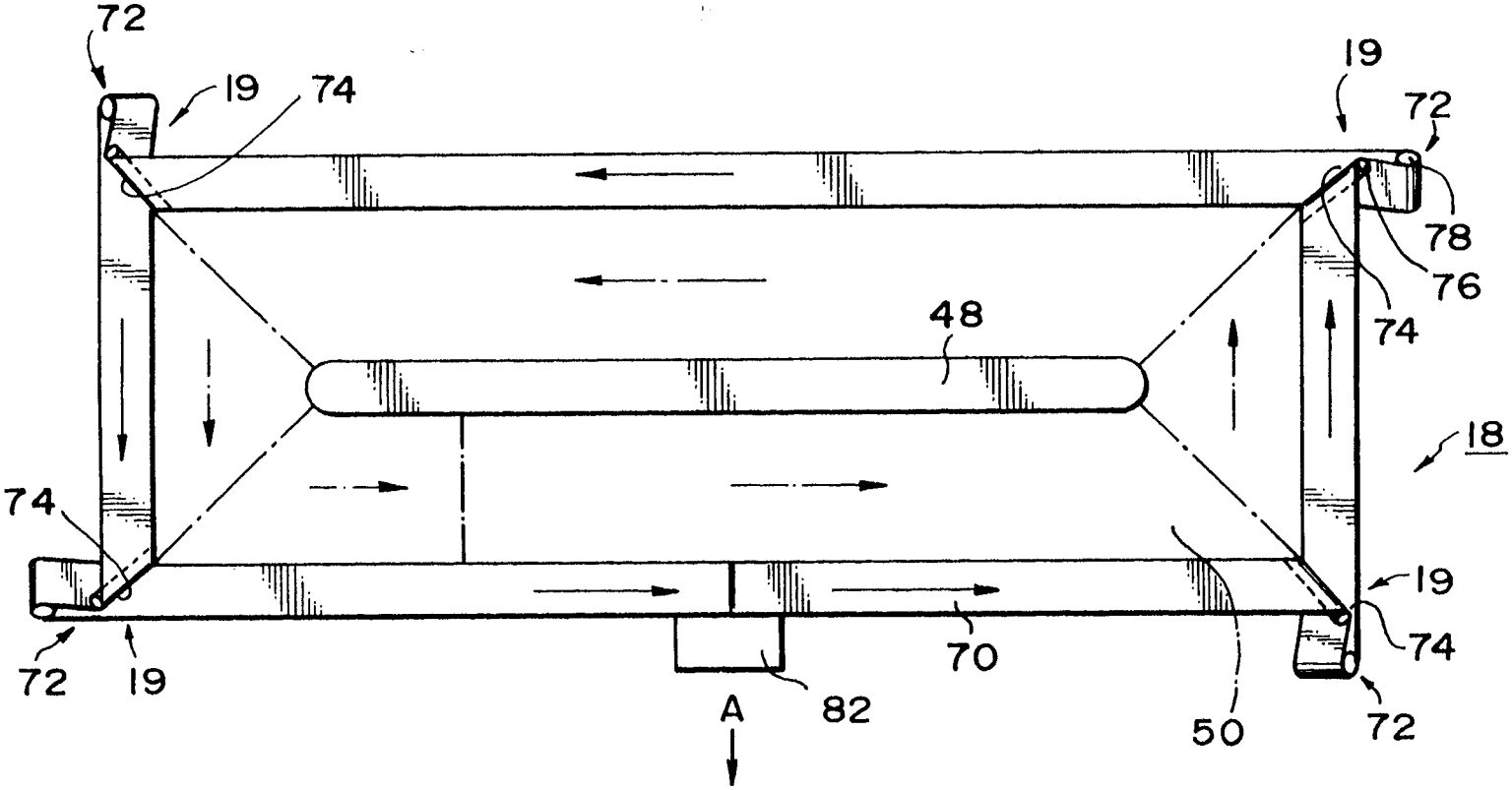
FIG. 5 is a plan view of a side conveyor belt usable in one embodiment of a game machine constructed in accordance with the present invention.

FIGS. 4 and 5 schematically show the construction of the conveyance platform 18. In these figures, arrow A represents the front side of the game machine.

As seen from FIG. 4, the conveyance platform 18 comprises a main conveyor belt 50 which is arranged to extend in the transverse direction and to surround the partition platform 48. The main conveyor belt 50 is moved around the partition platform 48 in a direction shown by an arrow in FIG. 4 such that various articles such as stuffed dolls, chocolates and the like will be endlessly conveyed.

As seen from FIG. 5, a side conveyor belt 70 is also arranged around the outer periphery of the main conveyor belt 50. The side conveyor belt 70 has its conveyance plane that is positioned in a direction intersecting the conveyance plane of the main conveyor belt 50. The articles conveyed by the main conveyor belt 50 are guided by the side conveyor belt 70 in the direction or conveyance.

Such a combination or the main conveyor belt 50 with the side conveyor belt 70 can reduce the damage of the articles conveyed by the main conveyor belt 50 at the outer periphery thereof.

In the illustrated embodiment, the speed of movement of the main conveyor belt 50 is set to be substantially the same as that of the side conveyor belt 70. Thus. articles P placed on the main conveyor belt 50 at the outer periphery thereof can be guided by the side conveyor belt 70 at the same speed, resulting in more reduction of the damage in the articles.

Figure 6:
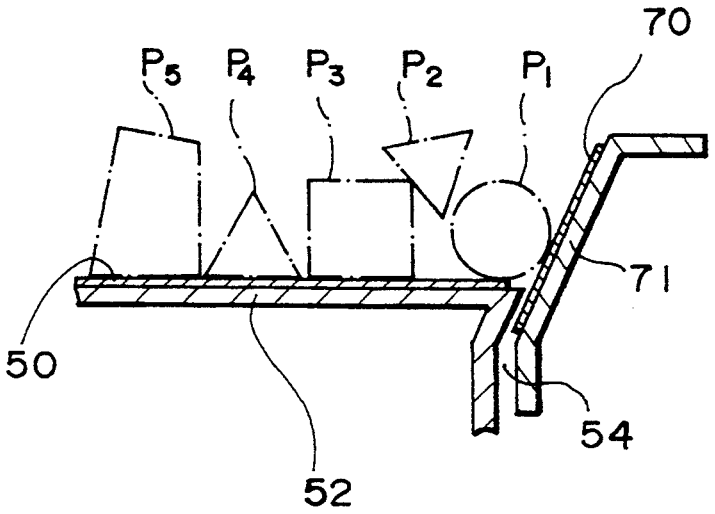
FIG. 6 is a cross-sectional view of the conveyance path, taken along a line 6—6 in FIG. 4.

FIG. 6 is a cross-sectional view of the conveyance platform 18 shown in FIG. 4, taken along a line 6—6 in the same figure.

The main conveyor belt 50 is slidably moved on a main conveyance frame 52 or metal which is arranged along the conveyance path.

The side conveyor belt 70 is also slidably moved on a side conveyance frame 71 of metal which is arranged along the conveyance path.

The side conveyor belt 70 has its conveyance plane that is tilted outwardly relative to a plane perpendicular to the conveyance plane of the main conveyor belt 50. In the illustrated embodiment, the conveyance plane of the side conveyor belt 70 is tilted outwardly by $\theta-25$ degrees relative to the plane perpendicular to the conveyance plane of the main conveyor belt 50. The lower side edge of the side conveyor belt 70 is positioned below the side edge of the main conveyor belt 50 so that thin plate-shaped article such as slab chocolates can reliably be conveyed by the main and side conveyor belts 50, 70.

This ensures that the urging force can be dispersed even if the articles P placed on the main conveyor belt 50 at the outer periphery thereof are urged against the outwardly tilted side conveyor belt 70. Thus, the damage of the articles can be further reduced.

A gap 54 for removing dirt is formed between the main and side conveyance frames 52, 71 entirely or partly over the circumference of the main conveyance frame 52. Dirt such as dust from stuffed dalls is removed through this gap 54.

When the conveyance system is defined by the main and side conveyor belts 50, 70 as in the conveyance platform 18 of the illustrated embodiment, the articles can effectively be agitated by co-operation of both the conveyor belts 50, 70 in the conveyance path at each corner 19.

In the illustrated embodiment, particularly, the internal angle at each corner is equal to 90 degrees. If many articles are being conveyed under such a condition as they are placed one above another, the articles can be agitated by the changing of the direction in which both the main and side conveyor belts 50, 70 move. Since the articles are agitated by simultaneous interaction between the main and side conveyor belts 50, 70, the articles can effectively be agitated in both the vertical and horizontal directions.

Such a situation is shown in FIGS. 7A–7D.

Figure 7A:
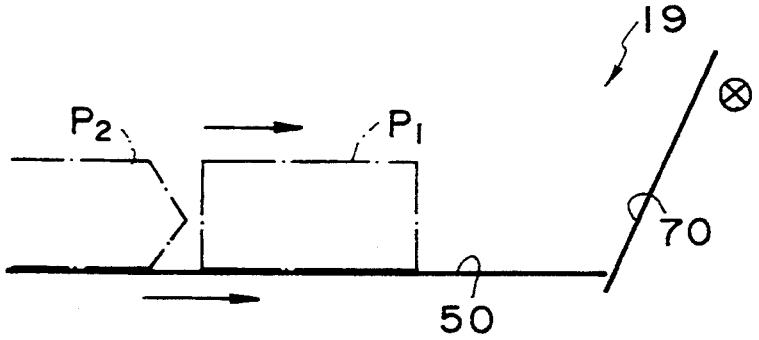
FIGS. 7A–7D illustrate a series of conveying operations in the conveyance path of the game machine at a corner.
Figure 7B:
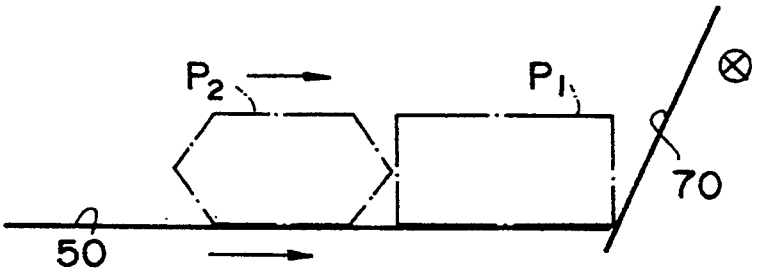
Figure 7C:
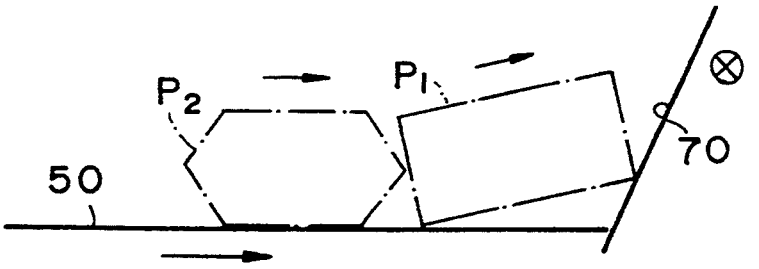
Figure 7D:
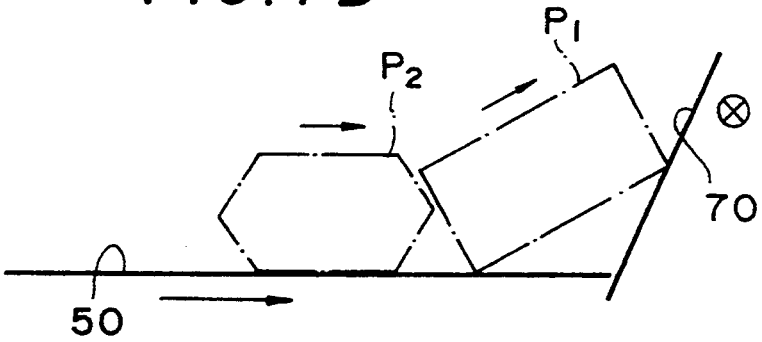

Referring first to FIG. 7A, it is now assumed that the main conveyor belt 50 successively conveys a first box-like article P1 and a second article P2 having sharpened points. As seen from FIG. 7B, the first article P1 is first prevented from further moving at a corner 19 and then impacted by the second article P2. As shown in FIGS. 7C and 7D, however, the first article P1 moves over the side conveyor belt 70 to attenuate the impact and is turned to a different direction since the side conveyor belt 70 is arranged to be tilted outwardly. Thus, the articles P can be protected from being damaged at each corner 19. Particularly, it can effectively be prevented that the first box-like article is deformed and damaged between the second article and the side conveyor belt 70.

In the illustrated conveyance platform 18, the articles P can continue to be conveyed in the endless manner for a long time while preventing them from being damaged as much as possible. At each corner 19 in the conveyance path, the articles P being conveyed are effectively agitated. Each of the articles P is differently directed at the passage of each corner 19. Therefore, the player can depress the button 26 and use the shovel arm 22 to pick up a desired article while viewing the articles agitated and differently directed For every round. This highly improves the amusingness in the crane type game machine.

The reduction of damage in the articles P conveyed on the conveyance platform 18 can provide the articles P of improved quality to the player.

The arrangement of the main and side conveyor belts 50, 70 will be described in more detail.

Figure 8:
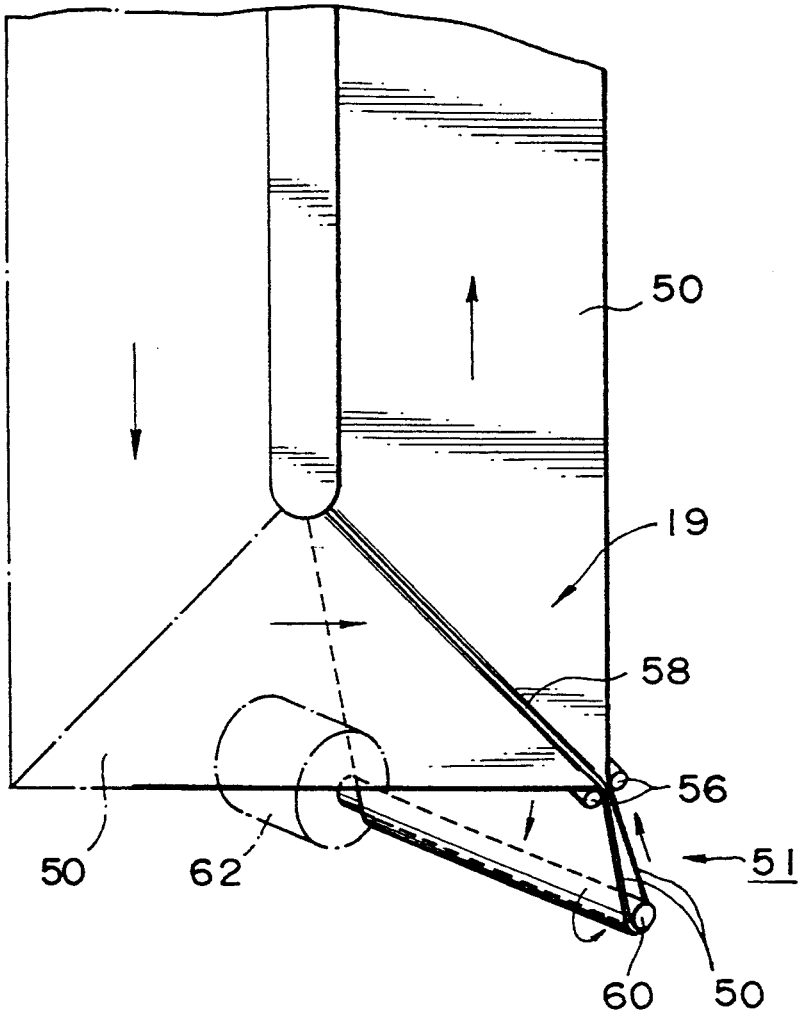
FIG. 8 a schematic view of the main belt turning mechanism in the main conveyor belt of FIG. 4 at a corner.
Figure 9:
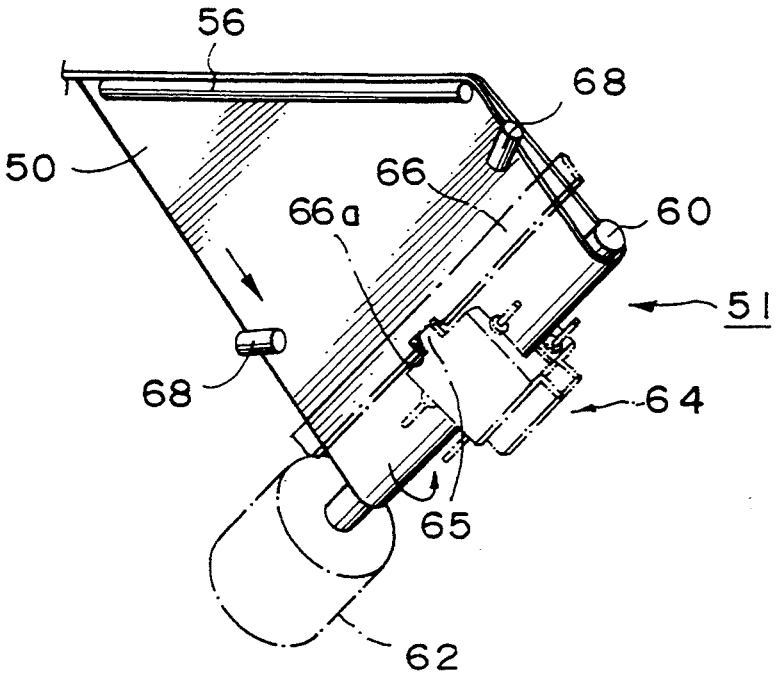
FIG. 9 is a schematic side view of the main belt turning mechanism shown in FIG. 8.

The main conveyor belt 50 is a single endless conveyor belt and is turned about a main conveyor belt turning portion 51 shown in FIGS. 8 and 9 at each corner shown in FIG. 4. The main conveyor belt 50 is turned about at least one belt tensioning and turning portion 53 which is disposed in a straight run of the conveyance path shown in FIG. 11.

FIGS. 8 and 9 show one main conveyor belt turning portion 51 at each corner 19. The components other than the main conveyor belt 50 and turning portion 51 are omitted for simplification. In order that such an arrangement can visually be understood, FIG. 8 shows a roller 60 and others which are shifted transversely rather than directly below a minute gap 58.

The main conveyor belt turning portion 51 comprises main conveyor belt drawing-in guides 56 that are arranged opposed to each other to form the gap 58 for drawing in the belt at each corner 19 (which gap intersects the direction of conveyance with an angle of 45 degrees), and a main conveyor belt turning roller 60 located below the guides 56 to absorb any slack in the main conveyor belt 50. Such main conveyor belt turning portions 51 are provided at four corners 19 shown in FIG. 4. In such a manner, the main conveyor belt 50 is arranged to form a rectangular layout of conveyance plane.

One of the main conveyor belt turning portions 51 at the respective corners 19 includes its main conveyor belt turning roller 60 that is operatively connected to a drive motor 62 as shown by alternate long and short dash line in FIG. 8. When the drive motor 62 is energized, the main conveyor belt 50 is driven in a direction of arrow.

If the frictional resistance between the roller 60 connected directly to the drive motor 62 and the main conveyor belt 50 is too small, the driven roller 60 is driven in the lost motion and the main conveyor belt 50 cannot effectively be driven. For such a reason, a clip 64 is used in the illustrated embodiment, as shown in FIG. 9. The clip 64 is detachably mounted on the driven roller 60 to hold and press the main conveyor belt 50 against the driven roller 60.

Figure 10:
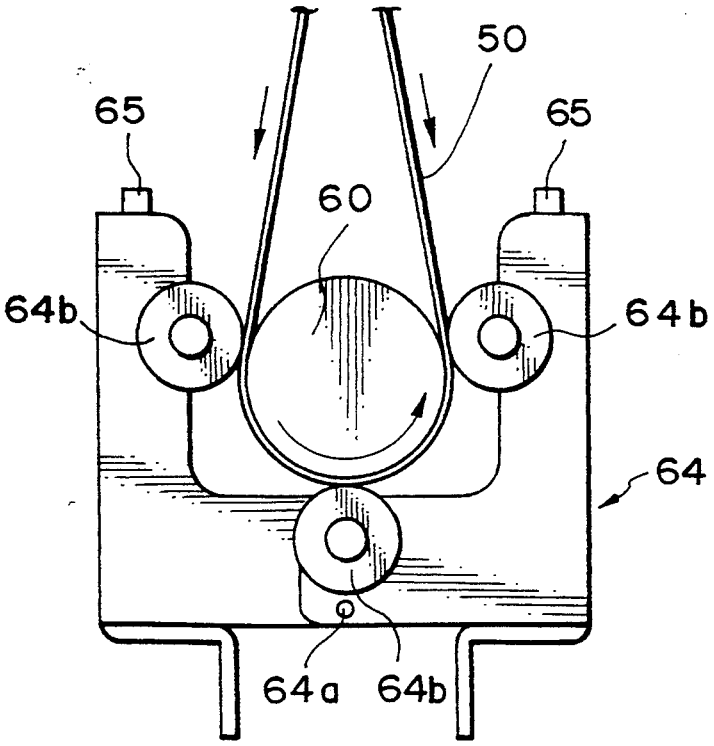
FIG. 10 is a cross-sectional view of the main belt turning mechanism shown in FIG. 9, with a clip being mounted on the drive roller.

FIG. 10 shows the cross-section of the clip 64 mounted on the driven roller 60. The clip 64 is elasticized about a shaft 64*a* to hold the roller 60 under pressure. The clip 64 has three spaced rollers 64*b* that urge the main conveyor belt 50 against the driven roller 60 under pressure. Thus, the rotation of the motor 62 can positively be transmitted to the main conveyor belt 50 through the roller 60 so that the main conveyor belt 50 can efficiently be driven in the direction of arrow.

The clip 64 is preferably positioned to hold the roller 60 substantially at the longitudinal center axis of the main conveyor belt 50. To this end, the forward ends of the clip 64 have positioning projections 65. These projections 65 engage in recesses 66*a* of a positioning frame 66 which is formed below the conveyance platform 18 (see FIG. 9).

As seen from FIG. 9, each of the main conveyor belt turning portions 51 includes positioning idlers 68 for preventing the main conveyor belt 50 from undesirably shifted. These idlers 68 function to tension and return the main conveyor belt 50 to its original position.

Figure 11:
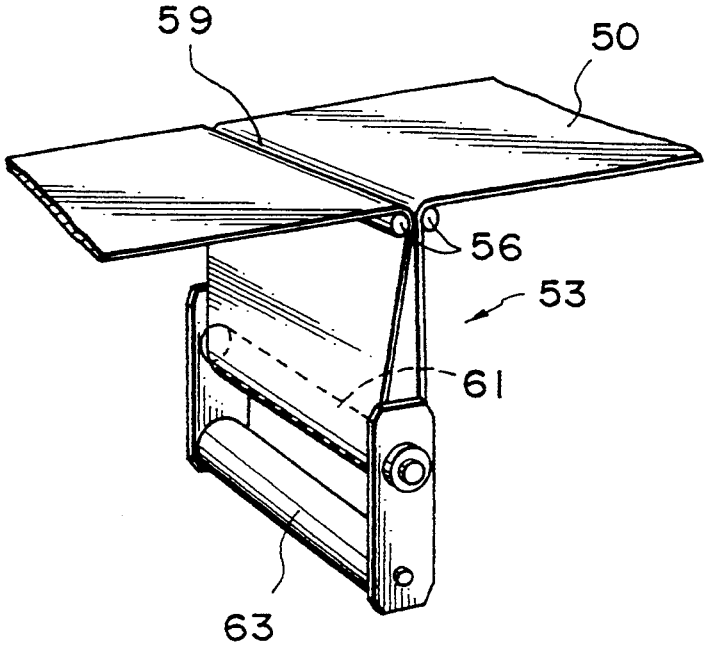
FIG. 11 is a schematic and perspective view of the tension roller turning mechanism used in the main conveyor belt.

FIG. 11 shows one of the belt tensioning and turning portion 53 that is located below a minute gap 59 shown in FIG. 4. The belt tensioning and turning portion 53 comprises main conveyor belt drawing-in guides 56 that are disposed opposed to each other to form the gap 59 for drawing in the belt from the conveyance path (which gap extends to intersect the direction of conveyance with an angle of 90 degrees), and a tensioning roller 61 located below the guides 56 and disposed to absorb any slack in the main conveyor belt 50. The ends of the tensioning roller 61 are fixedly connected to a weight 63 which applies an appropriate tension to the main conveyor belt 50 under gravity. In such a manner, the slack can be absorbed at any place in the conveyance path when the main conveyor belt 50 is being moved in the direction of arrow.

In the embodiment shown by FIGS. 8, 9 and 11, the belt drawing-in guides 56 may be replaced by the outwardly turned ends of the main conveyance frame 52 shown in FIG. 6.

The side conveyor belt 70 will now be described in detail.

The side conveyor belt 70 is a single endless conveyor belt. As shown in FIG. 5, the side conveyor belt 70 is turned about a side conveyor belt turning portion 72 at each corner 19 and further turned about a side conveyor belt drive 82 in the course of the conveyance path. The side conveyor belt 70 is driven in the direction of arrow.

Figure 12:
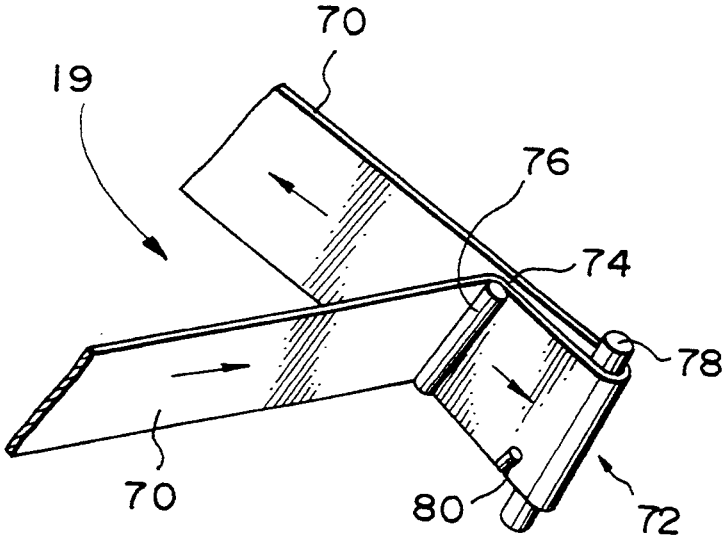
FIG. 12 is a schematic and perspective view or the side belt turning mechanism in the side conveyor belt at each corner.

FIG. 12 shows one side conveyor belt turning portion 72 at each corner 19. The components other than the side conveyor belt 70 and side conveyor belt turning portion 72 are omitted for simplification.

The side conveyor belt turning portion 72 comprises a side conveyor belt drawing-in guide 76 disposed to form a minute gap 74 for drawing in the side conveyor belt at each corner 19, and a side conveyor belt turning roller 78 for drawing the side conveyor belt 70 from the conveyance plane into the backside of the conveyance path through the gap 74. The side conveyor belt turning roller 78 is arranged such that the side conveyor belt 70 will be drawn in about the guide 76 through the gap 74 in a direction perpendicular to the upstream conveyance plane of the side conveyor belt 70 and also opposite to the downstream conveyance direction of the side conveyor belt 70.

In such an arrangement, the gap 74 formed at each corner 19 opens in a direction perpendicular to the upstream conveyance direction of the side conveyor belt 70, as shown in FIG. 5. Thus, the gap 74 can prevent articles and particularly thin plate-like articles from clogging therein.

the side belt drawing-in guide 76 shown in FIG. 12 may be replaced by the outwardly turned end of the side conveyance frame 71 shown in FIG. 6.

As shown in FIG. 12, the side conveyor belt turning portion 72 includes an idler 80 for preventing the side conveyor belt 70 from undesirably shifted. In the illustrated embodiment, the side conveyor belt 70 tends to be shifted downwardly since the side belt drawing-in guide 76 is outwardly tilted. Thus, the idler 80 is arranged to tension the side conveyor belt 70 drawn in through the gap 74 at the lower side edge thereof. If the side conveyor belt 70 is downwardly shifted, the idler 80 applies a force to the lower side edge of the side conveyor belt 70 so that the latter is returned to its original position.

Figure 13:
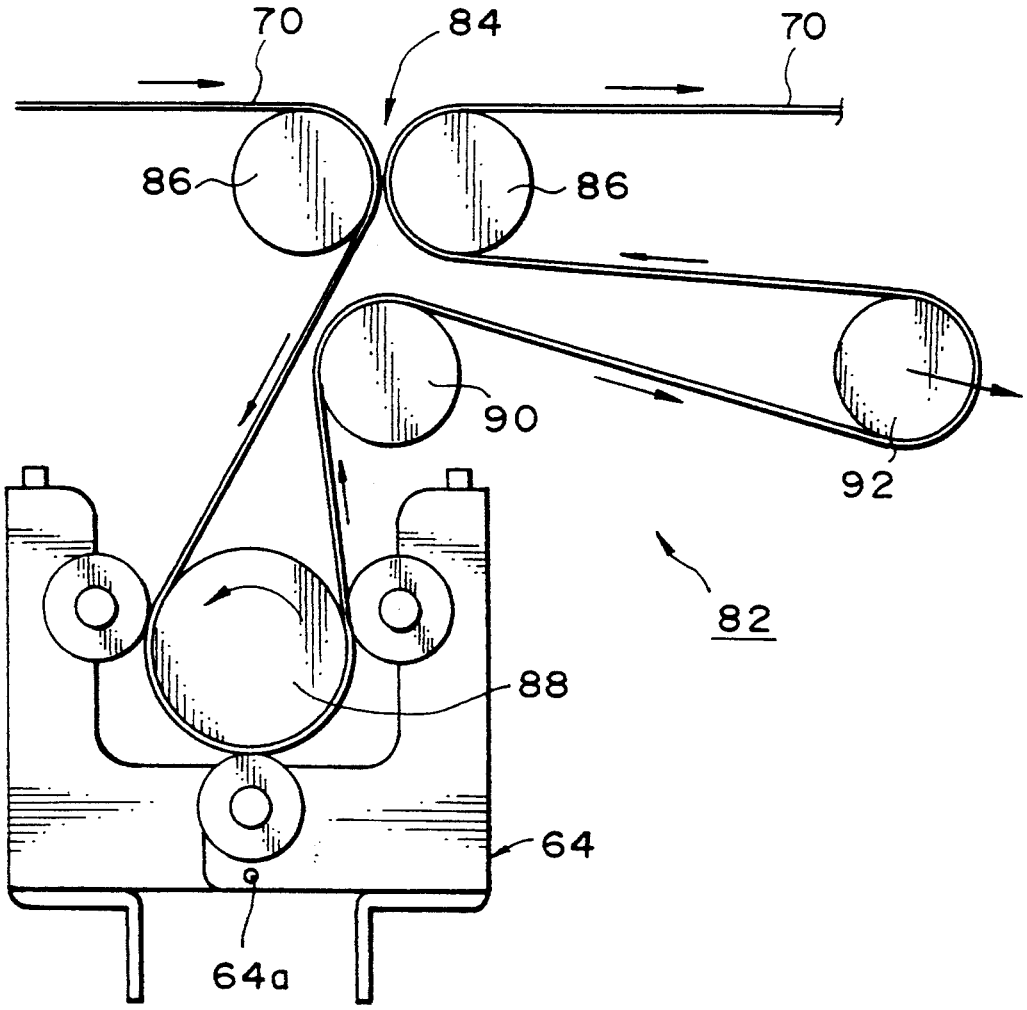
FIG. 13 is a schematic view of the drive mechanism for the side conveyor belt.

FIG. 13 schematically shows a side conveyor belt drive 82. In FIG. 13, the components other than the side conveyor belt 70 and its drive 82 are omitted for simplification.

The side conveyor belt drive 82 comprises side conveyor belt drawing-in guides 86 disposed opposite to each other to form a minute gap 84 for drawing in the side conveyor belt 70 therethrough, and drive, guide and tension rollers 88, 90 and 92, about all of which rollers the side conveyor belt 70 drawn in the backside of the conveyance plane through the gap 84 is turned. The drive roller 88 is rotatably driven in the direction of arrow by a motor (not shown) to move the side conveyor belt 70 in the direction or arrow. In order to prevent the side conveyor belt 70 from slipping on the drive roller 88, a clip 64 is detachably mounted about the drive roller 88 through the side conveyor belt 70 wound thereabout. The clip 64 is similar to that shown in FIGS. 9 and 10.

In order to absorb any slack in the side conveyor belt 70, a tension roller 92 is provided to tension the side conveyor belt 70 through a spring (not shown) in the direction of arrow at all times. When the side conveyor belt 70 is driven by the drive roller 88, therefore, it can be moved in the direction of arrow without any slack in the conveyance path at any place.

The side belt drawing-in guides 86 may be replaced by a slit that is formed in the side conveyance frame 71 of FIG. 6 with the opposite side edges thereof being turned inwardly.

The shovel robot 20 will now be described in detail.

Returning to FIG. 1, the shovel robot 20 is mounted on the partition platform 48 centrally located in the display space 16 and directed to the front of the display space.

Figure 2:
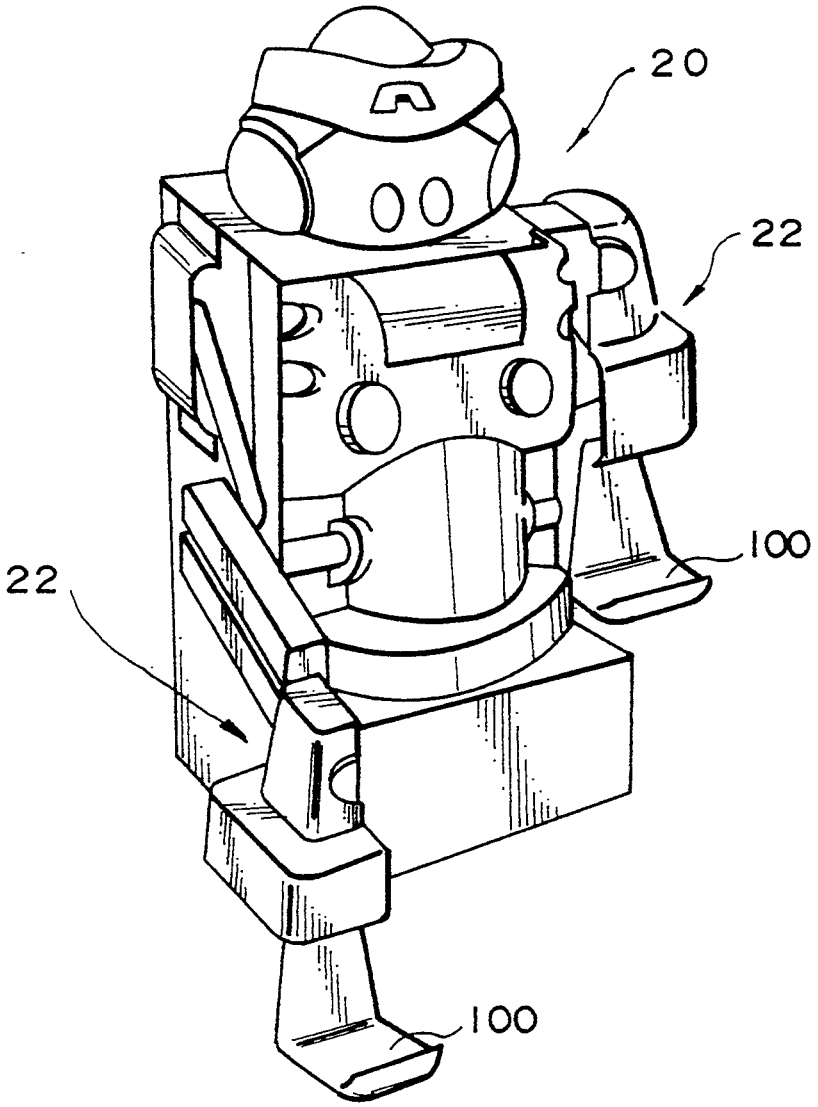
FIG. 2 is a schematic and perspective view of the shovel robot used in the game machine of FIG. 1.

Referring now to FIG. 2, the shovel robot 20 includes a pair of shovel arms 22 which are mounted thereon at the opposite sides. When each of the play buttons 26 is actuated, the corresponding shovel arm 22 is operated to pick up the articles conveyed on the conveyance platform 18. The pair of shovel arms 22 are of the safe structure. Therefore, only the right-side shovel arm 22 will be described with reference to FIG. 14.

The shovel arm 22 comprises a resiliently deformable bucket 100 and a bucket drive means 110.

In at least its forward pick-up tip 102, the bucket 100 may have a given rigidity and be resiliently deformable within a given extent. To this end, the bucket 100 is formed of a resilient plastic material in the illustrated embodiment.

The bucket drive means 110 supports the top of the bucket 100 so that it can be tilted. The bucket drive means 110 applies a force to the bucket 100 in a direction intersecting the conveyance path (of the main conveyor belt 50) in the conveyance platform 18 such that the bucket 100 can be tilted forwardly to pick up the articles. In the illustrated embodiment, the bucket drive means 110 is adapted to move the bucket 100 in a direction perpendicular to the direction of conveyance.

The illustrated embodiment is characterized by that the bucket 100 is tilted by the forward force while moving the tilting center 104 of the bucket 100 downwardly. Thus, the bucket 100 can be moved below the articles while its shape being resiliently deformed.

FIGS. 19A, 19B, 20A and 20B schematically illustrate the concrete operation of the shovel.

Figure 19A:
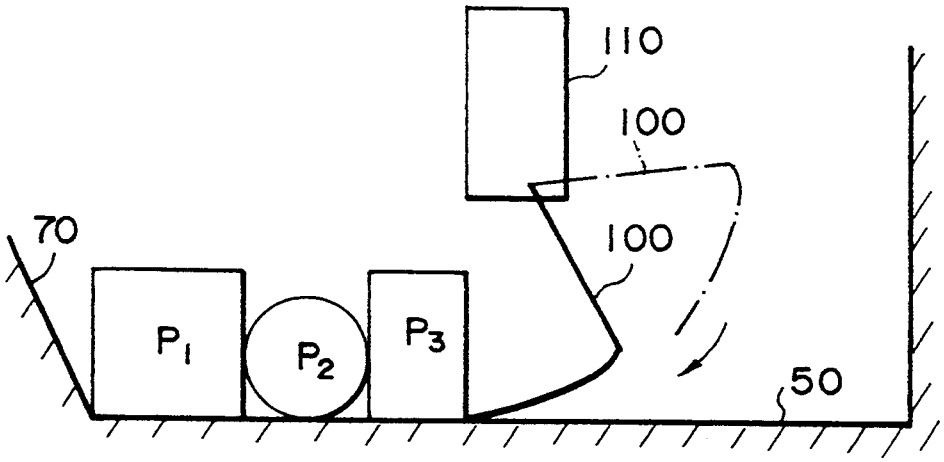
FIGS. 19A and 19B illustrate the picking-up of the articles by the bucket.
Figure 19B:
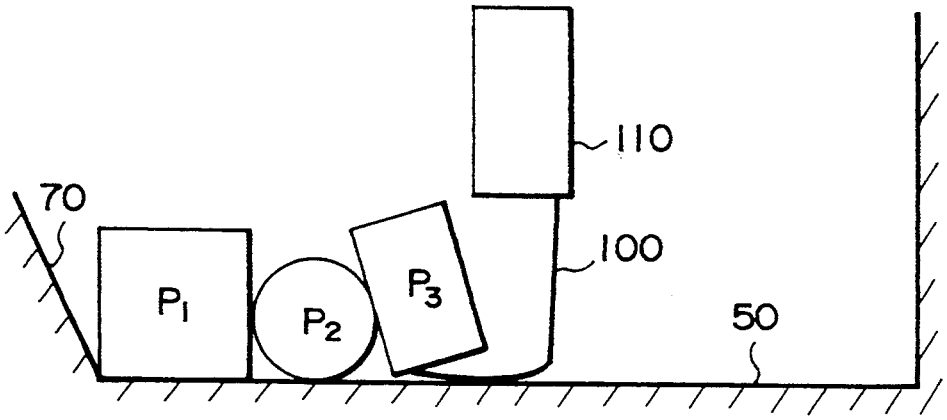

It is now assumed that articles P1, P2 and P3 are conveyed in a juxtaposed relationship on the conveyance path 50, as shown in FIG. 19A. IF the bucket 100 is actuated in such a manner as described, the forward pick-up tip 102 of the bucket 100 can simply be moved below the article P3 to pick up it, as shown in FIG. 19B.

On the contrary, if a further article P4 is conveyed while being placed adjacent to the article P3, the forward pick-up tip 102 of the bucket 100 will meet the side of the article P4, as shown in FIG. 2OA.

Figure 20A:
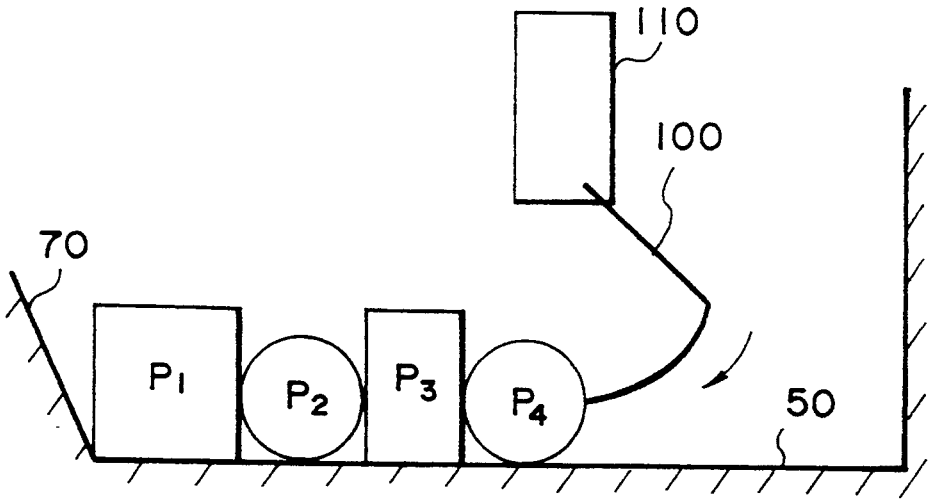
FIGS. 20A and 20B illustrate the picking-up of the articles by the bucket being downwardly moved.
Figure 20B:
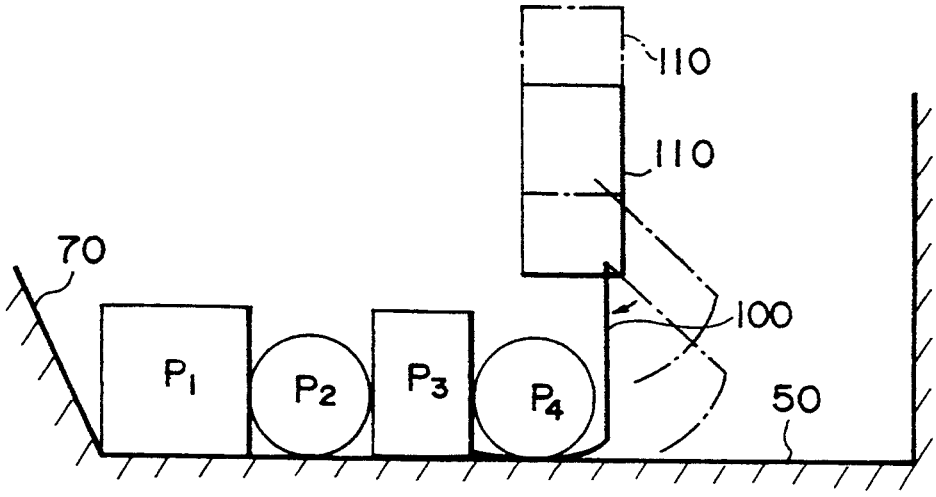

However, the tilting center 104 of the bucket 100 can be moved downwardly from FIG. 20A position to FIG. 20B position while the force is being applied to the bucket 100 in the direction of arrow. As a result, the forward pick-up tip 102 of the bucket 100 can be moved below the article P4 while being deformed.

In the illustrated embodiment, the bucket 100 can be moved while shifting its tilting center 104 downwardly, as shown in FIGS. 20A and 20B. This ensures that such an article P4 as not picked up by the prior art shovel arm can reliably be picked up by the bucket 100 of the present invention. This further improves the amusingness in the crane game.

Figure 14:
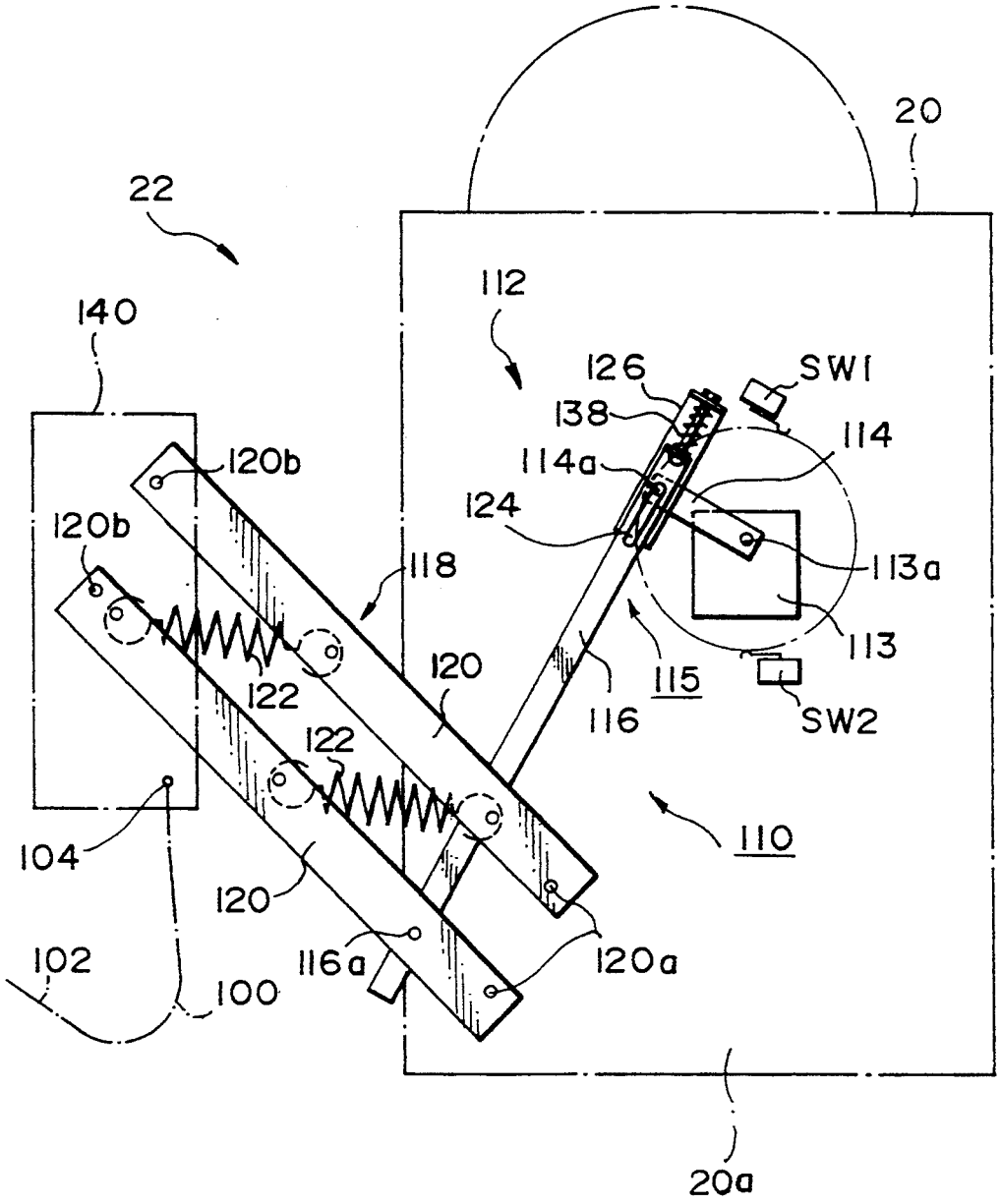
FIG. 14 is a schematic view of the entire construction of the shovel arm or the shovel robot shown in FIG. 2.

As shown in FIG. 14, the bucket drive means 110 comprises a bucket tilting drive 140 and a bucket elevating drive 112.

The bucket tilting drive 140 supports the top of the bucket 100 so that the latter can be tilted.

The bucket elevating drive 112 is adapted to move the bucket tilting drive 140 in the vertical direction to draw a given locus from a direction perpendicular to the direction of conveyance of the articles. The bucket elevating drive 112 comprises a motor 113 fixedly mounted on the side of the robot body **20*a*, a crank mechanism 115 fixedly mounted on the rotating shaft 113*a* of the motor 113 and adapted to transform the rotation of the motor 113 into a reciprocating linear motion, and an arm mechanism 118 for transforming the reciprocating liner motion of the crank mechanism 115 into a vertical oscillation to move the bucket tilting drive 140** in the vertical direction.

The crank mechanism 115 comprises a first crank arm 114 mounted on the rotating shaft **113*a* of the motor 113 and a second crank arm 116 pivotally connected to the first crank arm 114 through a pin and adapted to transform the rotational motion of the first crank arm 114** into a reciprocating linear motion.

The arm mechanism 118 comprises a pair of parallel arms 120 and another pair of springs 122. Each of the parallel arms 120 is pivotally connected at its one end to the side of the robot body **20*a* through a fixed shaft 120*a*. The other end of the arm 120 is pivotally connected to the side of the bucket tilting drive 140 through a fixed shaft 120*b*. Each of the springs 122 is operatively located between the parallel arms 120 to provide an auxiliary elastic force for lifting the bucket tilting drive 140**.

When the motor 113 is energized to rotate clockwise, the rotation thereof is transformed into a vertical motion through the second crank arm 116. Thus, the bucket tilting drive 140 and bucket 100 will be moved in the vertical direction to draw a given locus from the direction perpendicular to the conveyance direction of the articles. At this time, the angle of movement in the parallel arms 120 becomes 120 degrees as measured from the upright position thereof.

In the illustrated embodiment, particularly, the auxiliary elastic force is applied upwardly to the bucket tilting drive 140 and bucket 100 through the springs 122. As a result, the output of the motor 113 required to lift the bucket tilting drive 140 and bucket 100 can be reduced. This enables the motor to be reduced in its output.

FIGS. 21 to 24 illustrate a series of elevational operations carried out when the motor 113 is energized. As seen from these figures, the bucket 100 can be moved in the vertical direction along a given locus when the motor 113 rotates the first crank arm 114 clockwise through one complete revolution.

The pin-connection between the second crank arm 116 and the first crank arm 114 includes an arrangement which can protect the mechanism from any mechanical impact if the bucket or associated member is knocked by any obstruction to prevent its downward movement.

Figure 15:
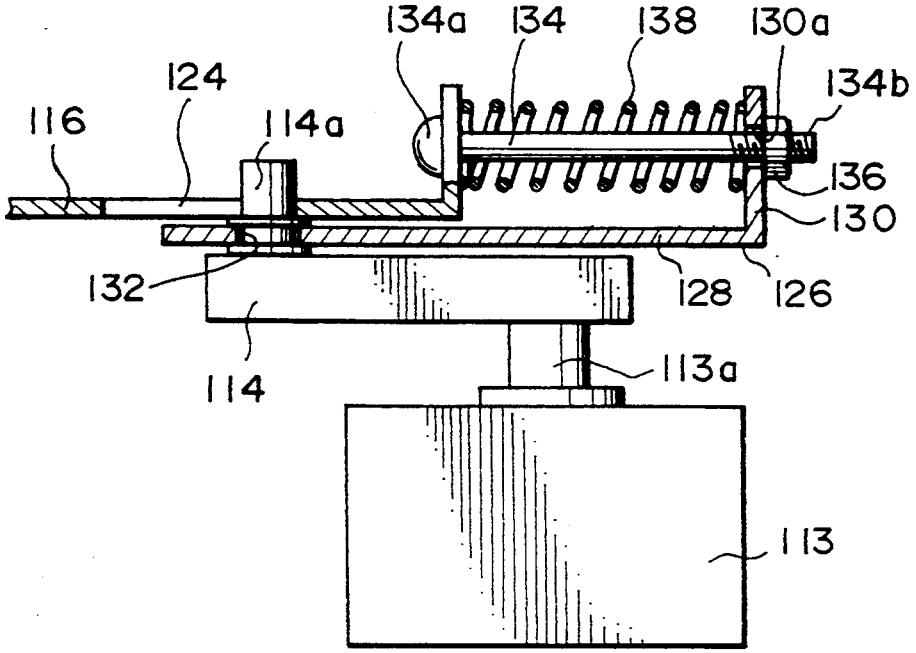
FIG. 15 is a view of the connection between the arm link and the arm crank in the shovel arm of FIG. 14.

FIG. 15 shows the details of such a mechanism. The second crank arm 116 includes an elongated slot 124 formed therein to receive an arm crank shaft **114*a* such that it can be moved in the slot 124**.

A balance link 126 of L-shaped cross-section is located between the end of the second crank arm 116 and the first crank arm 114. The balance link 126 is adapted to elasticize the second crank arm 116 leftwardly through a spring 138. More particularly, one leg 128 of the L-shaped balance link 126 is pivotally connected to the crank shaft **114*a* through an aperture 132 formed therein. A bolt 134 extends between the other leg 130 of the balance link 126 and the end of the second crank arm 116 and through apertures formed therein. A spring 138 is located around the bolt 134 between the other leg 130 of the balance link 126 and the end of the second crank arm 116. A nut 136 is screwed over the threaded end of the bolt 134. More particularly, the head 134***a* of the bolt 134 is fixed to the end of the second crank arm 116 while the threaded rod portion 134*b* is movably inserted through an aperture 130*a* formed in the leg 130 of the balance link 126. The nut 136 is screwed over the end of the threaded rod portion 134*b* so that the bolt 134 will not be drawn out accidentally.

If the second crank arm 116 is prevented from being moved for any reason, the crank shaft 114*a* will be moved by a distance corresponding to the length of the slot 124 in a direction opposite to the elastic force of the spring 138. As a result, an impact applied from the crank shaft 114*a* to the second crank arm 116 can be attenuated. When the obstruction on the downward movement is removed, the spring 138 moves the second crank arm 116 to its normal position in the leftward direction as viewed in FIG. 15.

As shown in FIG. 14, two micro-switches SW1 and SW2 are angularly spaced away from each other and adjacent to the circular locus of the first crank arm 114. These micro-switches can be actuated by the first crank arm 114 when it is rotated.

The micro-switch SW1 is disposed to detect the position of the first crank arm 114 corresponding to the uppermost point (top dead center) of the rotation center 104 of the bucket 100 so that a state determined when the rotation center 104 of the bucket 100 is elevated to the top dead center can be detected. The micro-switch SW2 is arranged to detect the position of the first crank arm 114 corresponding to a position somewhat forward from the lowermost point (bottom dead center) of the rotation center 104 of the bucket 100 so that the position of the rotation center 104 of the bucket 100 when it is lowered to a position somewhat forward of the bottom dead center can be detected.

The bucket tilting drive 140 connected to the tip of the arm mechanism 118 in the elevating drive 112 will now be described.

Figure 16:
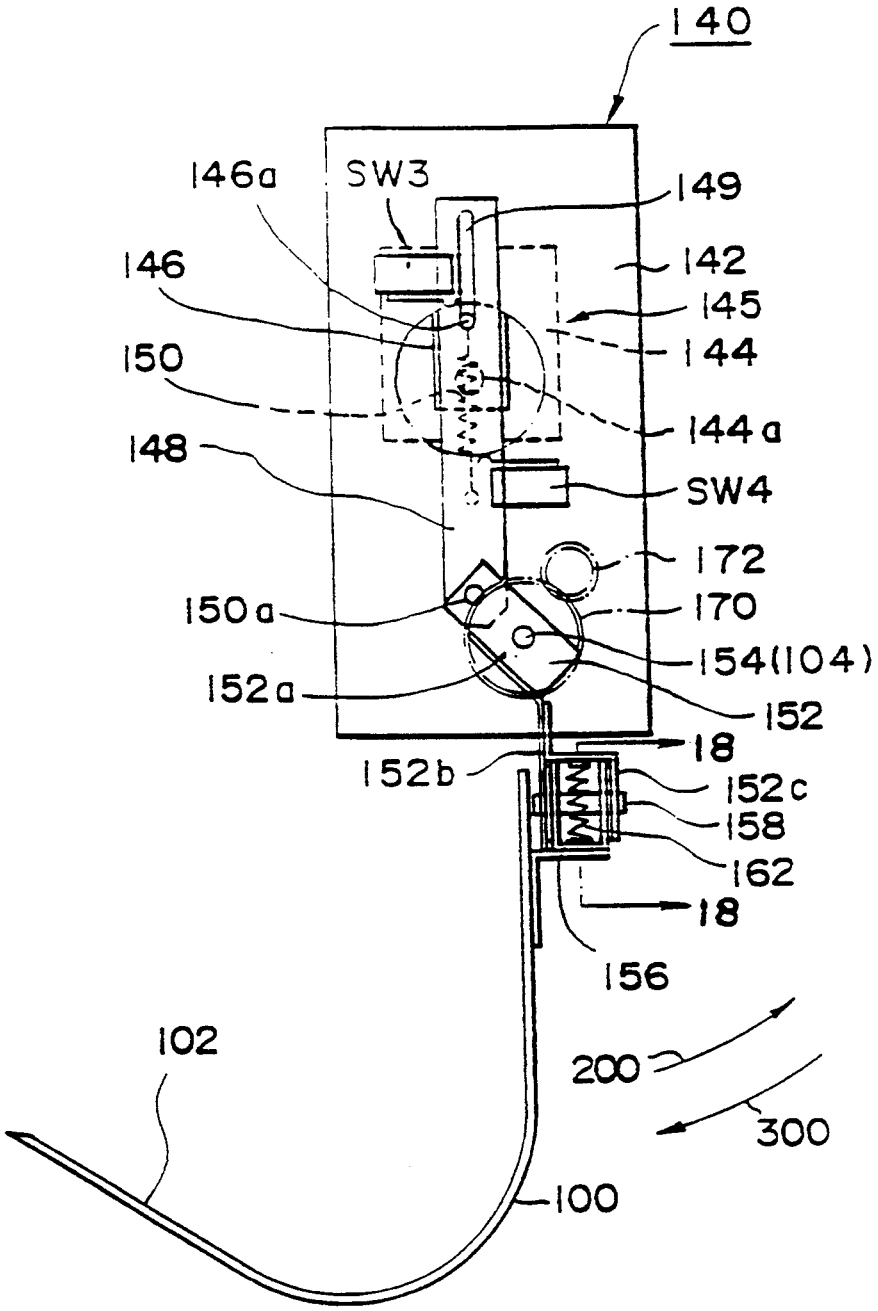
FIG. 16 is a schematic side view of the bucket tilting drive or the shovel arm shown in FIG. 14.
Figure 17:
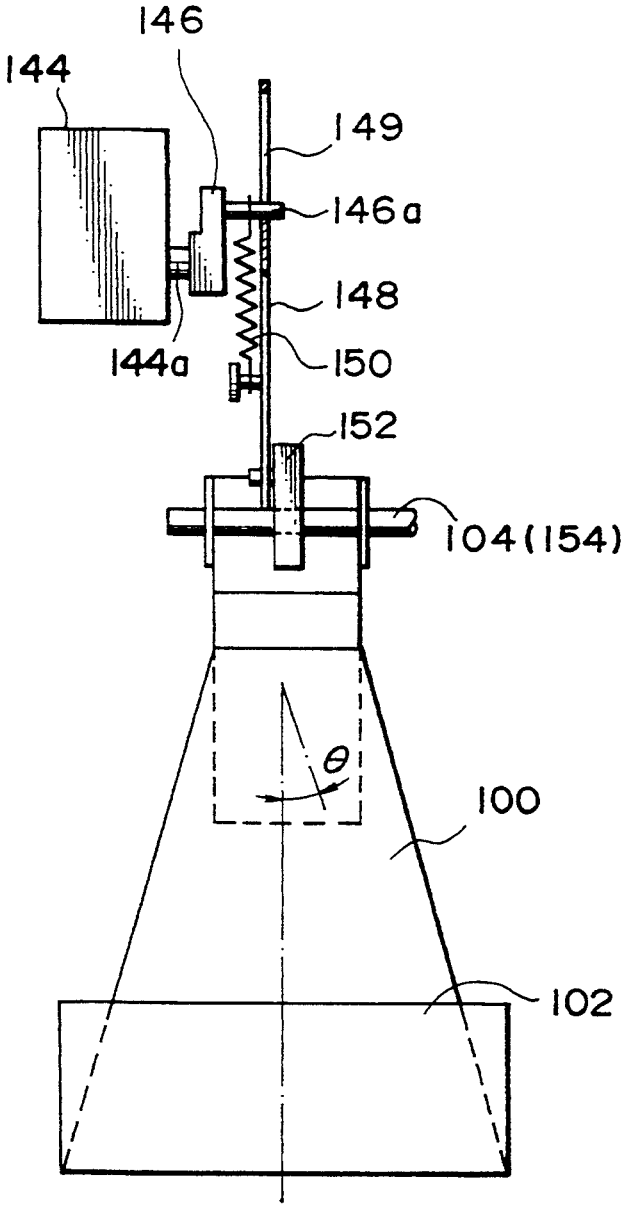
FIG. 17 is a schematic front view of the bucket tilting drive shown in FIG. 16.

FIG. 16 schematically shows the arrangement of the bucket tilting drive 140 while FIG. 17 schematically illustrates the left side of the arrangement as viewed in FIG. 16.

The bucket tilting drive 140 comprises a motor 144 fixedly mounted on a main drive body 142, a crank mechanism 145 mounted on the output shaft 144*a* of the motor 144 and adapted to transform the rotation of the motor into a reciprocating linear motion, and a bucket stay 152 for transforming the reciprocating motion of the crank mechanism 145 into a horizontal oscillation. The bucket tilting drive 140 causes the bucket 100 to perform its forward shoveling operation and its backward retracting operation.

The crank mechanism 145 comprises a first crank arm 146 fixedly mounted on the output shaft 144*a* of the motor 144 and a second crank arm 148 pivotally connected to the first crank arm 146 through a pin-connection and adapted to transform the rotation of the first crank arm 146 into a reciprocating linear motion.

The pin-connection between the first and second crank arms 146, 148 includes the crank shaft 146*a* of the first crank arm 146 pivotally engaged by an elongated slot 149 in the second crank arm 148. A tension and elasticity spring 150 is operatively located between the crank shaft 146*a* of the first crank arm 146 and the second crank arm 148.

As the motor 144 is energized, its rotation is transformed into a circular motion through the first crank arm 146. The circular motion is then transformed into a vertically linear motion through the second crank arm 148.

The end of the second crank arm 148 is pivotally connected to one end of the bucket stay 152 through a shaft 150*a*. The bucket stay 159. comprises three stay members 152*a*, 152*b* and 152*c*. The stay member 152*a* is pivotally connected to the drive body 142 through a rotating shaft 154 which is positioned at the tilting center 104 of the bucket 100. The other stay members 152*b* and 152*c* are fixedly mounted on a stay connection 156 of C-shaped cross-section which in turn is fixedly mounted on the bucket 100.

As the motor 144 is energized, the first crank arm 146 is rotatably driven with the rotation being transformed into the vertically linear motion through the second crank arm 148. Thus, the bucket 100 will be tilted about the rotation center 154 in such direction as shown by arrows 200 and 300 in FIG. 16. Particularly, if the first crank arm 146 is at twelve o'clock position as shown in FIG. 16, the second crank arm 148 has been lifted. Therefore, the bucket 100 is control led to such a position as shown by solid line in FIG. 16.

As the first crank arm 146 is rotated clockwise from twelve o'clock position to six o'clock position, the second crank arm 148 is moved downwardly. Thus, the bucket 100 will be tilted in the direction of arrow 200. During the movement of the first crank arm 146 from six o'clock position to twelve o'clock position, the bucket 100 will be tilted in the direction of arrow 300.

In the illustrated embodiment, the slot 149 and bucket spring 150 are particularly provided to absorb any impact when the tilting of the bucket 100 in the direction of arrow 300 is obstructed for any reason. For example, if the tilting of the bucket 100 is obstructed as shown in FIG. 20A, the crank shaft 146*a* is moved in the slot 149 in its longitudinal direction to absorb the impact. Since at this time the crank shaft 146*a* moves to expand the spring 150, the spring 150 continues to elasticize the bucket 100 in the direction of arrow 300. If the obstruction is removed, the bucket 100 is tilted in the direction of arrow 300 under the elastic force of the spring 150. An impact created when the bucket 100 is tilted in the direction of arrow 300 under the elastic force may be attenuated through a spur gear 170 that is mounted on the rotating shaft 154 of the stay 152. The spur gear 170 engages an impact absorbing rotary damper 172 which is rotatably mounted on the drive body 142. In such a manner, any impact produced when the bucket 100 is rapidly tilted cannot be transmitted to the entire structure including the bucket and arms.

Two micro-switches SW3 and SW4 are provided to detect the position of the bucket 100 and adapted to indirectly sense the position of the bucket 100 through the angle of the first crank arm 146. More particular, the micro-switch SW3 is mounted on the drive body 142 to detect the first crank arm 146 when it is in its twelve o'clock position. The micro-switch SW4 is mounted on the drive body 142 to sense the first crank arm 146 when it is its six o'clock position.

When an article is picked up by the bucket in such a manner as shown in FIGS. 19A, 19B, 20A and 20B, it is required to protect the entire mechanism by absorbing an impact created when the subsequently conveyed article strikes the side of the bucket 100. To this end, an impact absorbing mechanism is provided between the bucket stay 152 and the stay connection 156.

Figure 18:
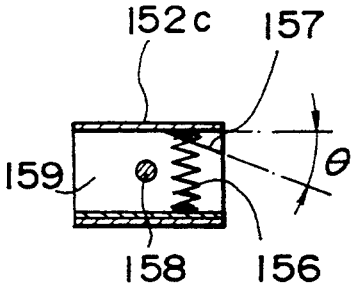
FIG. 18 is a schematic cross-section taken along a line 18—18 in FIG. 16.

Referring now to FIG. 18, the stay connection 156 includes a notch 157 formed therein at the right shoulder and adapted to permit the counter-clockwise rotation of the stay connection 156 about the shaft 158 by an angle $\theta$. A compression spring 159 is further operatively located between the stay 152*c* and the stay connection 156 to apply a elastic force to the stay connection 156 so that it will be rotated clockwise.

If an article being conveyed strikes the side of the bucket 100, the bucket 100 can be tilted with the stay connection 156 by the angle $\theta$ against the elastic force or the compression spring 159 to absorb the impact. If the bucket 100 is released from the article striking the side thereof, the bucket 100 will be returned to its original position under the elastic force of the spring 159.

In such a manner, the entire mechanism may be protected from the impact by absorbing it even if many articles being conveyed strike the side of the bucket 100.

Figure 25:
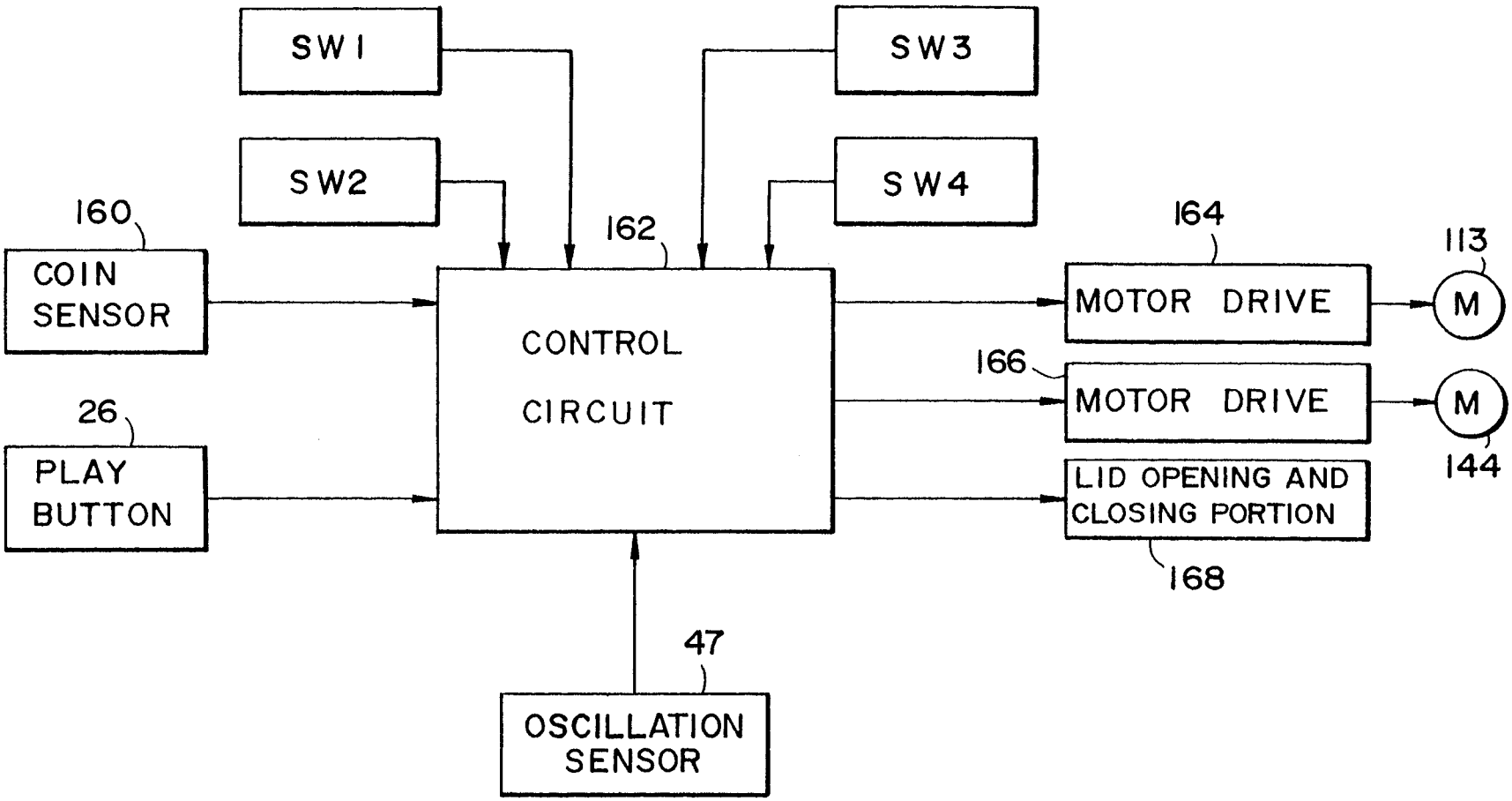
FIG. 25 is a block diagram of the primary parts of a drive and control mechanism for the shovel arm.

FIG. 25 shows a control circuit for the shovel robot 20 and for opening and closing the lid plate 46 shown in FIG. 3.

When the game machine is in its inoperative state, normally, the first crank arm 114 shown in FIG. 14 is in its position in which the micro-switch SW1 is turned on by the first crank arm 114. The bucket 100 is in its uppermost position. The first crank arm 146 of FIG. 16 is in its position in which the micro-switch SW4 is turned on by the first crank arm 146 while the bucket 100 is drawn in the direction of arrow 200 to direct its open top downwardly.

As a coin is inserted into the slot 26 under the above conditions, a coin sensor 160 senses the inserted coin to generate an output detection signal toward the control circuit 162.

When a given coin is thrown into the coin slot 26, the control circuit 162 actuates the lid opening and closing portion 168 to rotate the lid plate 46 from the position shown by alternate long and short dash line in FIG. 3 to the position shown by solid line in the same figure. As a result, the article gaining port 24 is opened. If the player intentionally oscillates the housing body 12 to take out articles during the game playing, the oscillation sensor 47 will sense such an intensional oscillation. The control circuit 162 actuates the lid opening and closing portion 168 so that the lid plate 46 is forcedly closed. This prevents any unfair practice.

The player may operate the play button 26 depending on his prediction for passage of an article to be gained while viewing the articles successively conveyed on the conveyance platform 18.

Figure 26:
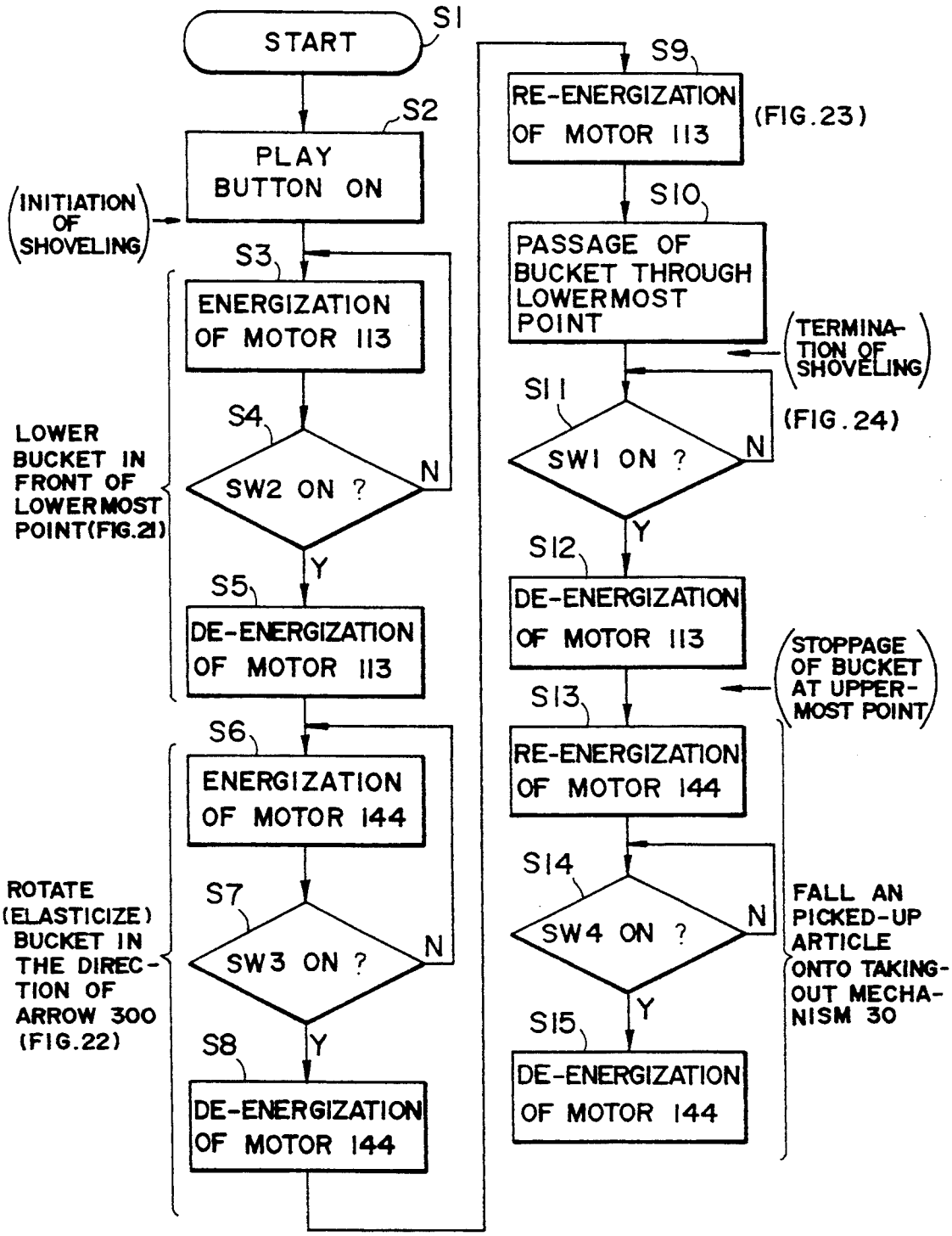
FIG. 26 is a flowchart illustrating the operation of the control circuit shown in FIG. 25.

FIG. 26 shows a flowchart illustrating the operation of the control circuit 162 when the play button 26 is manipulated by the player.

Figure 21:
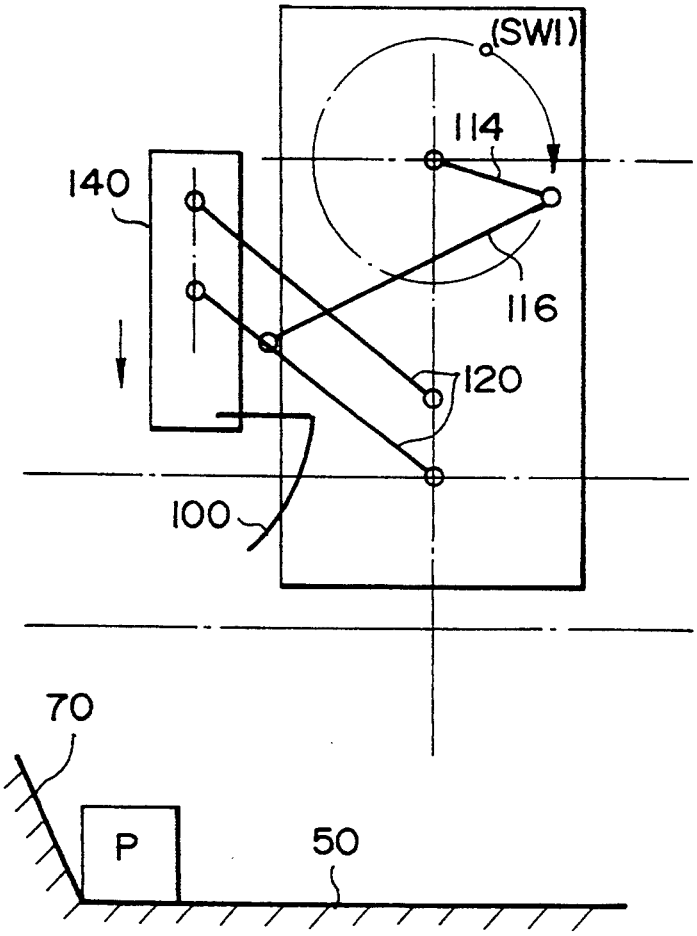
FIG. 21 is a view illustrating the operation of the shovel arm.

When the game is initiated (S1) and the play button 26 is turned on (S2), the control circuit 162 controls the motor drive 164 to energize the motor 113 (S3). The first crank arm 114 is initiated to rotate clockwise from the position corresponding to the micro-switch SW1, such that the bucket 100 will be moved downwardly to draw the locus perpendicular to the conveyance path as shown in FIG. 21.

Figure 22:
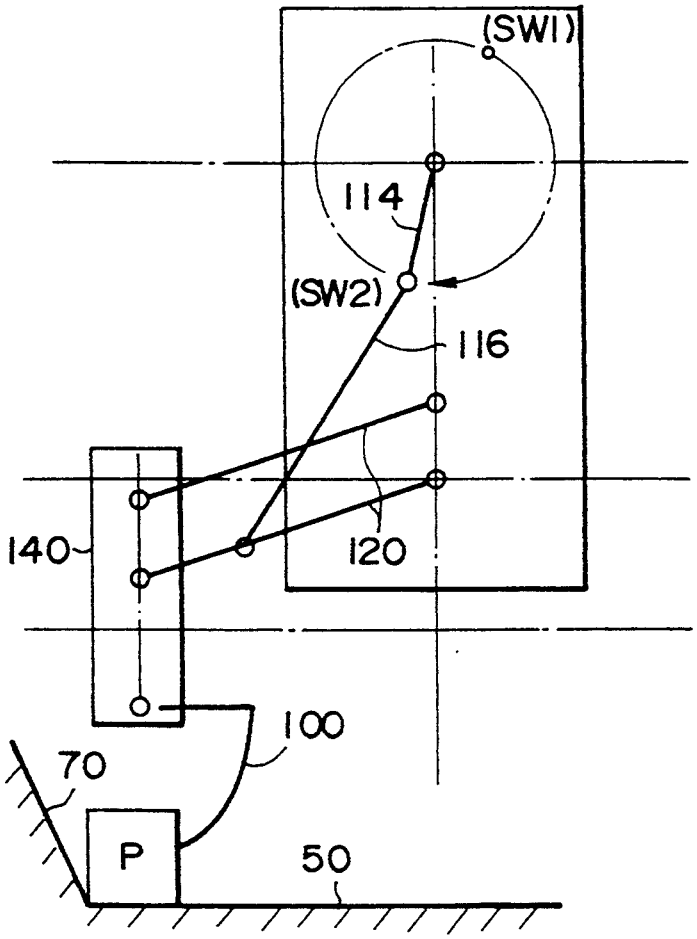
FIG. 22 is a view illustrating the operation or the shovel arm.

As the first crank arm 114 reaches the position in which the micro-switch SW2 is to be turned on, the micro-switch SW2 senses the first crank arm 114 (54). Thus, the control circuit 162 de-energizes the motor 113 (S5). This is shown in FIG. 22. Under such a situation, the bucket 100 has been stopped forwardly of the lowermost point thereof.

As the micro-switch SW2 is turned on, the control circuit 162 energizes the motor 144 through the motor drive 166 to rotate the first crank arm 146 from the micro-switch SW4 toward the micro-switch SW3 clockwise as shown in FIG. 16. The bucket 100 is initiated to move in the direction of arrow 300 for picking up the articles. As the micro-switch SW3 is turned on by the first crank arm 146 (S7), the motor 144 is de-energized (S8).

If the bucket 100 is positioned relative to the articles on the conveyance path as shown in FIG. 19A, the bucket 100 can pick up an article P3.

However, if the bucket 100 is positioned relative to the articles as shown in FIG. 20A, the bucket 100 cannot move in the direction of arrow 300 by being blocked by the article P4. The bucket 100 is prevented from moving while being subjected to the elastic force in the direction of arrow 300.

Figure 23:
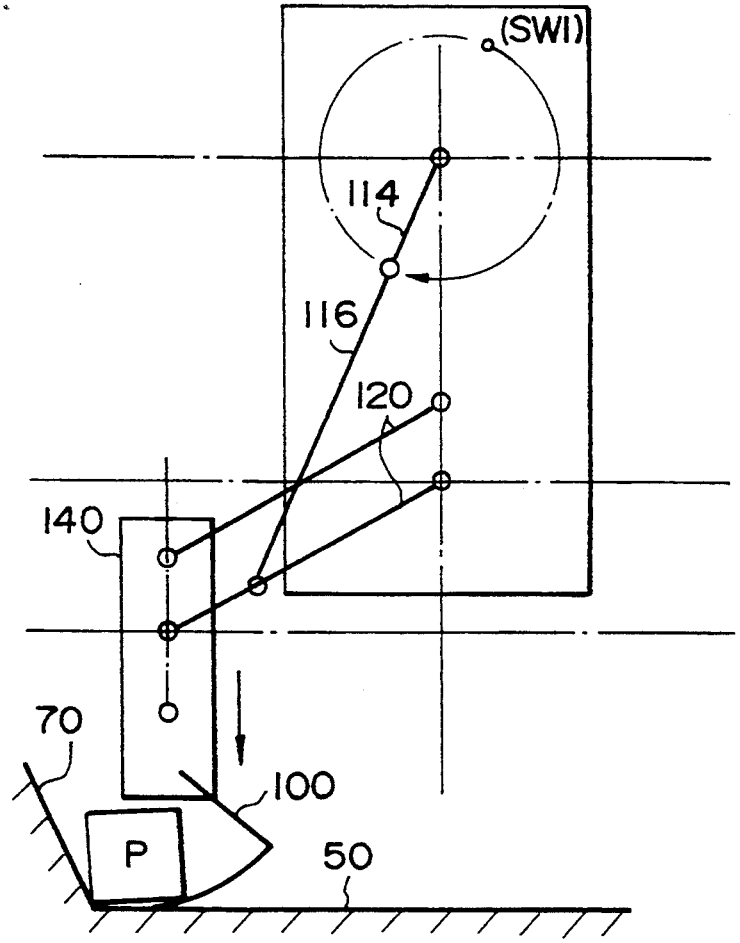
FIG. 23 is a view illustrating the operation of the shovel arm.

Under such a state, the control circuit 162 re-starts the motor 113 (S9) to move the bucket 100 to its lowermost position as shown in FIG. 23. The forward pick-up tip 102 of the bucket 100 can be resiliently deformed to move below the article P4. This is shown in FIG. 23.

At time when the bucket 100 has passed through its lowermost position (S10), the bucket 100 can move below the article P4 to pick up it, as shown in FIG. 20B.

Figure 24:
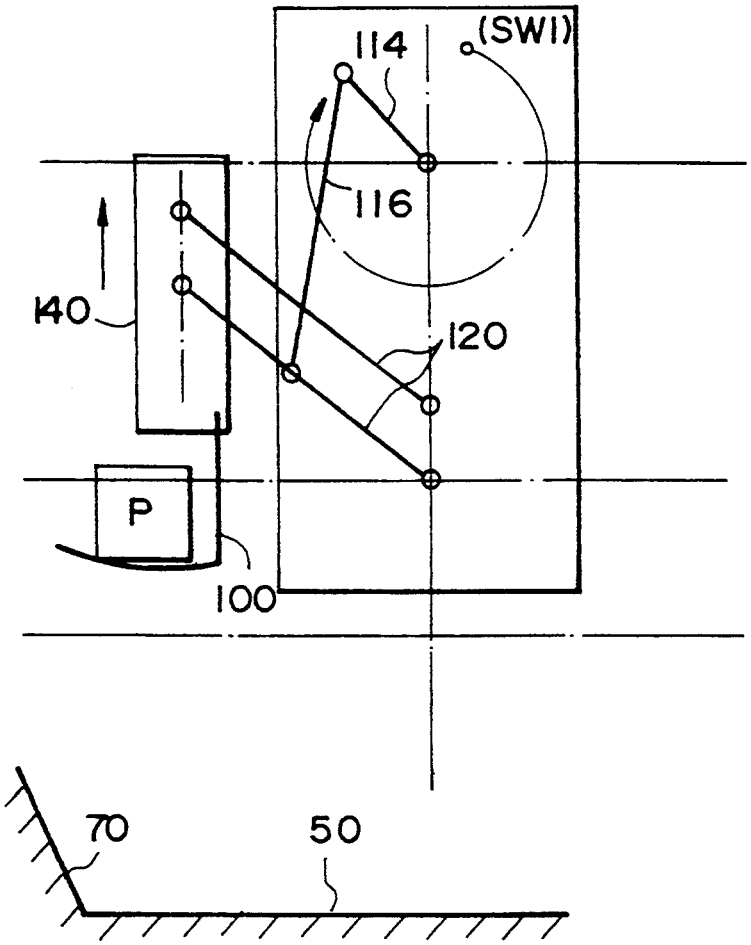
FIG. 24 is a view illustrating the operation of the shovel arm.

After the article P4 has been picked up by the bucket 100, the first crank arm 114 is actuated to elevate the bucket 100, as shown in FIG. 24. Immediately when the micro-switch SW1 is turned on by the first crank arm 114, the motor 113 is de-energized (S11 and S12). The bucket 100 is stopped at its upper-most position.

In such a situation, the control circuit 162 re-starts the motor 144 to rotate the first crank arm 146 from the micro-switch SW3 (twelve o'clock position) to the micro-switch SW4 (six o'clock position) clockwise (S13, S14 and S15). The bucket 100 is thus tilted in the direction of arrow 200 to fall the picked-up article onto the sloping plate 36 shown in FIG. 1.

In such a manner, even if the bucket 100 is placed in such a position as shown in FIG. 20A, the shovel robot 20 can further move the bucket 100 downwardly so that the article can reliably be picked up by the bucket 100, as shown in FIG. 20B. This further improves the amusingness in the shovel game.

Although the illustrated embodiment has been described as to the shovel type game machine which can pick up the articles being conveyed on the display platform, the present invention is not limited to such a shovel type game machine and may be applied to a shovel type game machine which comprises a stationary display platform and bucket drive means movable to pick up the articles at any location.

More particularly, the present invention may be applied to such a shovel type game machine that bucket drive means pivotally supporting a bucket is adjustably movable in X- and Y-directions parallel to the display platform, thereby picking up the articles at a preselected location.

In the aforementioned embodiment, the second crank arm 148 includes the elongated slot 149 with which the crank shaft 146*a* engages for movement along the length of the slot 149. Furthermore, the spring 150 is operatively located between the crank shaft 146*a* and the second crank arm 148 and provides elastic force for tilting the bucket 100. However, the present invention is not limited to such an arrangement and may be applied to any different arrangement for tilting the bucket 100.

For example, the lower end of the second crank arm 148 may also include an elongated slot formed therein. The slot may receive the shaft 150*a*. Moreover, another spring 150 which provides tension like the first spring is operatively located between the shaft 150*a* and the second crank arm 148 such that similar elastic force for tilting can be applied to the bucket 100.

In such a manner, the present invention can provide an improved shovel type game machine which can securely pick up articles without trouble from the position and scatter of the articles on the display platform.

The present invention is particularly very suitable for use in such a game machine that articles being conveyed on the display platform are picked up by the bucket. Even when the articles are broadly scattered over the conveyance path and difficult to be picked up with the bucket because of engagement of the bucket tip with the side of any one of the articles as in the prior art, the present invention can securely pick up the articles. This can greatly improve the amusingness in the crane game.

We claim:

1. A shovel type game machine comprising a display platform and shovel arm means for picking up articles on the display platform, said shovel arm means comprising:

a resiliently deformable bucket for picking up the articles and bucket drive means for pivotally supporting said bucket and for tilting said bucket forwardly with a given force, thereby causing said bucket to perform a shoveling operation for picking up said articles, said bucket drive means being adapted to make said shoveling operation by moving the pivot center of said bucket downwardly, whereby said bucket can be resiliently deformed to move its tip below said articles.

2. A shovel type game machine comprising a display platform for conveying articles and shovel arm means for picking up articles on the display platform, said shovel arm means comprising:

a resiliently deformable bucket for picking up the articles and bucket drive means for pivotally supporting said bucket and for tilting said bucket forwardly across the direction of conveyance with a given force, thereby causing said bucket to perform a shoveling operation for picking up said articles, said bucket drive means being adapted to make said shoveling operation by moving the pivot center of said bucket downwardly, whereby said bucket can be resiliently deformed to move its tip below said articles.

3. A shovel type game machine as defined in claim 1 wherein said bucket drive means comprises:

a bucket tilting drive for pivotally supporting the bucket, a bucket elevating drive for moving the bucket tilting drive in the vertical direction to draw a given locus, and a drive control section for stopping the downward movement of said bucket elevating drive before the lowest position of said bucket and then initiating said shoveling operation while causing said bucket tilting drive to tilt said bucket forwardly with said force and thereafter for re-initiating the downward movement of said bucket tilting drive, whereby the tip of said bucket can move below the articles while resiliently deforming said bucket.

4. A shovel type game machine as defined in claim 2 wherein said bucket drive means comprises:

a bucket tilting drive for pivotally supporting the bucket, a bucket elevating drive for moving the bucket tilting drive in the vertical direction to draw a given locus, and a drive control section for stopping the downward movement of said bucket elevating drive before the lowest position of said bucket and then initiating said shoveling operation while causing said bucket tilting drive to tilt said bucket forwardly with said force and thereafter for re-initiating the downward movement of said bucket tilting drive, whereby the tip of said bucket can move below the articles while resiliently deforming said bucket.

5. A shovel type game machine as defined in claim 3 wherein said bucket elevating drive comprises:

a first rotating drive on the main body of said bucket elevating drive, a first crank mechanism for transforming the rotational motion of said first rotating drive into a reciprocal linear motion, and an arm mechanism for transforming the reciprocal motion of said first crank mechanism into a vertically oscillating motion to move said bucket tilting drive in the vertical direction.

6. A shovel type game machine as defined in claim 5 wherein said first crank mechanism comprises:

a first crank arm fixedly mounted on the rotating shaft of said first rotating drive, a second crank arm pivotally connected to said first crank arm through a pin-connection and adapted to transform the rotational motion of said first crank arm into a reciprocal linear motion, said first and second crank arms being associated with each other to move the pin-connection within a preselected extent, said pin-connection being elasticized to position forward in the rotating direction of said first crank arm, whereby an impact by the downward movement of said arm mechanism can be absorbed by moving said pin-connection.

7. A shovel type game machine as defined in claim 5 wherein said arm mechanism comprises:

a pair of parallel arms each having one end pivotally connected to the main body of said bucket elevating drive, with the other end thereof being pivotally connected to said bucket tilting drive, and elasticizing means operatively located between said arms for providing auxiliary elastic force to lift said bucket tilting drive.

8. A shovel type game machine as defined in claim 6 wherein said arm mechanism comprises:

a pair of parallel arms each having one end pivotally connected to the main body of said bucket elevating drive, with the other end thereof being pivotally connected to said bucket tilting drive, and elasticizing means operatively located between said arms for providing auxiliary elastic force to lift said bucket tilting drive.

9. A shovel type game machine as defined in claim 4 wherein said bucket elevating drive comprises:

a first rotating drive on the main body of said bucket elevating drive, a first crank mechanism for transforming the rotational motion of said first rotating drive into a reciprocal linear motion, and an arm mechanism for transforming the reciprocal motion of said first crank mechanism into a vertically oscillating motion to move said bucket tilting drive in the vertical direction.

10. A shovel type game machine as defined in claim 9 wherein said first crank mechanism comprises:

a first crank arm fixedly mounted on the rotating shaft or said first rotating drive, a second crank arm pivotally connected to said first crank arm through a pin-connection and adapted to transform the rotational motion of said first crank arm into a reciprocal linear motion, said first and second crank arms being associated with each other to move the pin-connection within a preselected extent, said pin-connection being elasticized to position forward in the rotating direction of said first crank arm, whereby an impact by the downward movement of said arm mechanism can be absorbed by moving said pin-connection.

11. A shovel type game machine as defined in claim 9 wherein said arm mechanism comprises:

a pair of parallel arms each having one end pivotally connected to the main body of said bucket elevating drive, with the other end thereof being pivotally connected to said bucket tilting drive, and elasticizing means operatively located between said arms for providing auxiliary elastic force to lift said bucket tilting drive.

12. A shovel type game machine as defined in claim 10 wherein said arm mechanism comprises:

a pair of parallel arms each having one end pivotally connected to the main body of said bucket elevating drive, with the other end thereof being pivotally connected to said bucket tilting drive, and elasticizing means operatively located between said arms for providing auxiliary elastic force to lift said bucket tilting drive.

13. A shovel type game machine as defined in claim 3 wherein said bucket tilting drive comprises:

a second rotating drive fixedly mounted on the main body of said bucket tilting drive, a second crank mechanism for transforming the rotational motion of said second rotating drive into a reciprocal linear motion, and an oscillating mechanism for transforming the reciprocal motion of said second crank mechanism into a horizontal oscillating motion to cause said bucket to perform a forward shoveling operation and a backward retracting operation.

14. A shovel type game machine as defined in claim 13 wherein said second crank mechanism comprises:

a first bucket crank arm fixedly mounted on the rotating shaft of said second rotating drive, and a second bucket crank arm pivotally connected to said first bucket crank arm through a pin-connection and adapted to transform the rotational motion of said first bucket crank arm into a reciprocal linear motion, said pin-connection between said second bucket crank arm and said first crank arm or said oscillating mechanism being formed as a movable pin-connection for moving within a preselected extent, said movable pin-connection being elasticized such that said pin-connection is positioned on the preselected side of said second bucket crank arm, whereby when said shoveling operation is obstructed for any reason, said shoveling operation can be continued under the action of said elastic force.

15. A shovel type game machine as defined in claim 14 wherein said oscillating mechanism includes a damper for attenuating any rapid oscillation, said damper being adapted to attenuate the rapid motion of said bucket when the obstruction against said bucket is removed during said shoveling operation.

16. A shovel type game machine as defined in claim 6 wherein said bucket tilting drive comprises:

a second rotating drive fixedly mounted on the main body of said bucket tilting drive, a second crank mechanism for transforming the rotational motion of said second rotating drive into a reciprocal linear motion, and an oscillating mechanism for transforming the reciprocal motion of said second crank mechanism into a horizontal oscillating motion to cause said bucket to perform a forward shoveling operation and a backward retracting operation.

17. A shovel type game machine as defined in claim 16 wherein said second crank mechanism comprises:

a first bucket crank arm fixedly mounted on the rotating shaft of said second rotating drive, and a second bucket crank arm pivotally connected to said first bucket crank arm through a pin-connection and adapted to transform the rotational motion of said first bucket crank arm into a reciprocal linear motion, said pin-connection between said second bucket crank arm and said first crank arm or said oscillating mechanism being formed as a movable pin-connection for moving within a preselected extent, said movable pin-connection being elasticized such that said pin-connection is positioned on the preselected side of said second bucket crank arm, whereby when said shoveling operation is obstructed for any reason, said shoveling operation can be continued under the action of said elastic force.

18. A shovel type game machine as defined in claim 17 wherein said oscillating mechanism includes a damper for attenuating any rapid oscillation, said damper being adapted to attenuate the rapid motion of said bucket when the obstruction against said bucket is removed during said shoveling operation.

19. A shovel type game machine as defined in claim 4 wherein said bucket tilting drive comprises:

a second rotating drive fixedly mounted on the main body of said bucket tilting drive.

a second crank mechanism for transforming the rotational motion of said second rotating drive into a reciprocal linear motion, and an oscillating mechanism for transforming the reciprocal motion of said second crank mechanism into a horizontal oscillating motion to cause said bucket to perform a forward shoveling operation and a backward retracting operation.

20. A shovel type game machine as defined in claim 19 wherein said second crank mechanism comprises:

a first bucket crank arm fixedly mounted on the rotating shaft of said second rotating drive, and a second bucket crank arm pivotally connected to said first bucket crank arm through a pin-connection and adapted to transform the rotational motion of said first bucket crank arm into a reciprocal linear motion, said pin-connection between said second bucket crank arm and said first crank arm or said oscillating mechanism being formed as a movable pin-connection for moving within a preselected extent, said movable pin-connection being elasticized such that said pin-connection is positioned on the preselected side of said second bucket crank arm, whereby when said shoveling operation is obstructed for any reason, said shoveling operation can be continued under the action of said elastic force.

21. A shovel type game machine as defined in claim 19 wherein said oscillating mechanism includes a damper for attenuating any rapid oscillation, said damper being adapted to attenuate the rapid motion of said bucket when the obstruction against said bucket is removed during said shoveling operation.

22. A shovel type game machine as defined in claim 19 wherein said bucket is mounted on said oscillating mechanism for tilting movement from a reference point within a preselected range of angle and elasticized back to the reference point, whereby when an article being conveyed strikes the side of said bucket, the resulting impact can be absorbed by said bucket and when the obstruction is removed, said bucket can be returned to the reference point with elastic force.

23. A shovel type game machine as defined in claim 10 wherein said bucket tilting drive comprises:

a second rotating drive fixedly mounted on the main body of said bucket tilting drive, a second crank mechanism for transforming the rotational motion of said second rotating drive into a reciprocal linear motion, and an oscillating mechanism for transforming the reciprocal motion of said second crank mechanism into a horizontal oscillating motion to cause said bucket to perform a forward shoveling operation and a backward retracting operation.

24. A shovel type game machine as defined in claim 23 wherein said second crank mechanism comprises:

a first bucket crank arm fixedly mounted on the rotating shaft of said second rotating drive, and a second bucket crank arm pivotally connected to said first bucket crank arm through a pin-connection and adapted to transform the rotational motion of said first bucket crank arm into a reciprocal linear motion, said pin-connection between said second bucket crank arm and said first crank arm or said oscillating mechanism being formed as a movable pin-connection for moving within a preselected extent, said movable pin-connection being elasticized such that said pin-connection is positioned on the preselected side of said second bucket crank arm, whereby when said shoveling operation is obstructed for any reason, said shoveling operation can be continued under the action of said elastic force.

25. A shovel type game machine as defined in claim 24 wherein said oscillating mechanism includes a damper for attenuating any rapid oscillation, said damper being adapted to attenuate the rapid motion of said bucket when the obstruction against said bucket is removed during said shoveling operation.

26. A shovel type game machine as defined in claim 24 wherein said bucket is mounted on said oscillating mechanism for tilting movement from a reference point within a preselected range of angle and elasticized back to the reference point, whereby when an article being conveyed strikes the side of said bucket, the resulting impact can be absorbed by said bucket and when the obstruction is removed, said bucket can be returned to the reference point with elastic force.

27. A shovel type game machine as defined in claim 14 wherein said drive control section comprises:

a first detector means for detecting movement of the pivot center of said bucket the uppermost position, a second detector means for detecting movement of the pivot center of said bucket to a position somewhat forwardly of the lowermost position thereof, a third detector means for detecting movement of said second rotating drive in said bucket tilting drive to a position corresponding to the final position in said shoveling operation, and a fourth detector means for detecting movement of said second rotating drive in said bucket tilting drive to a position corresponding to the final position in said retracting operation.

28. A shovel type game machine as defined in claim 27 further comprising a player's operation section for controlling the shovel arm means and wherein said drive control means is:

responsive to an operation signal from said player's operation section to initiate the downward movement of said bucket elevating drive, responsive to a detection signal from said second detector means to temporarily stop the downward movement or said bucket elevating drive and also to cause the second rotating drive of said bucket tilting drive to initiate said shoveling operation while tilting said bucket forwardly with a given force, responsive to a detection signal from said third detector means to stop the rotation of said second rotating drive in said bucket tilting drive and also to re-initiate the downward movement of said bucket elevating drive followed by the upward movement of the same, responsive to a detection signal from said first detector means to stop the upward movement of said bucket elevating drive and also to cause the second rotating drive of said bucket tilting drive to initiate the retracting movement of said bucket while tilting said bucket backwardly, and responsive to a detection signal from said fourth detector means to stop said retracting movement of said bucket.

29. A shovel type game machine as defined in claim 17 wherein said drive control section comprises:

a first detector means for detecting movement of the pivot center of said bucket the uppermost position, a second detector means for detecting movement of the pivot center of said bucket to a position somewhat forwardly of the lowermost position thereof, a third detector means for detecting movement of said second rotating drive in said bucket tilting drive to a position corresponding to the final position in said shoveling operation, and a fourth detector means for detecting movement of said second rotating drive in said bucket tilting drive to a position corresponding to the final position in said retracting operation.

30. A shovel type game machine as defined in claim 29 further comprising a player's operation section for controlling the shovel arm means and wherein said drive control means is:

responsive to an operation signal from said player's operation section to initiate the downward movement of said bucket elevating drive, responsive to a detection signal from said second detector means to temporarily stop the downward movement of said bucket elevating drive and also to cause the second rotating drive of said bucket tilting drive to initiate said shoveling operation while tilting said bucket forwardly with a given force, responsive to a detection signal from said third detector means to stop the rotation of said second rotating drive in said bucket tilting drive and also to re-initiate the downward movement of said bucket elevating drive followed by the upward movement of the same, responsive to a detection signal from said first detector means to stop the upward movement of said bucket elevating drive and also to cause the second rotating drive of said bucket tilting drive to initiate the retracting movement of said bucket while tilting said bucket backwardly, and responsive to a detection signal from said fourth detector means to stop said retracting movement of said bucket.

31. A shovel type game machine as defined in claim 20 wherein said drive control section comprises:

a first detector means for detecting movement of the pivot center of said bucket the uppermost position, a second detector means for detecting movement of the pivot center of said bucket to a position somewhat forwardly of the lowermost position thereof, a third detector means for detecting movement of said second rotating drive in said bucket tilting drive to a position corresponding to the final position in said shoveling operation, and a fourth detector means for detecting movement of said second rotating drive in said bucket tilting drive to a position corresponding to the final position in said retracting operation.

32. A shovel type game machine as defined in claim 31 further comprising a player's operation section for controlling the shovel arm means and wherein said drive control means is:

responsive to an operation signal from said player's operation section to initiate the downward movement of said bucket elevating drive, responsive to a detection signal from said second detector means to temporarily stop the downward movement of said bucket elevating drive and also to cause the second rotating drive of said bucket tilting drive to initiate said shoveling operation while tilting said bucket forwardly with a given force, responsive to a detection signal from said third detector means to stop the rotation of said second rotating drive in said bucket tilting drive and also to re-initiate the downward movement of said bucket elevating drive followed by the upward movement of the same, responsive to a detection signal from said first detector means to stop the upward movement of said bucket elevating drive and also to cause the second rotating drive of said bucket tilting drive to initiate the retracting movement of said bucket while tilting said bucket backwardly, and responsive to a detection signal from said fourth detector means to stop said retracting movement of said bucket.

33. A shovel type game machine as defined in claim 26 wherein said drive control section comprises:

a first detector means for detecting movement of the pivot center of said bucket the uppermost position, a second detector means for detecting movement of the pivot center of said bucket to a position somewhat forwardly of the lowermost position thereof, a third detector means for detecting movement of said second rotating drive in said bucket tilting drive to a position corresponding to the final position in said shoveling operation, and a fourth detector means for detecting movement of said second rotating drive in said bucket tilting drive to a position corresponding to the final position in said retracting operation.

34. A shovel type game machine as defined in claim 33 further comprising a player's operation section for controlling the shovel arm means and wherein said drive control means is:

responsive to an operation signal from said player's operation section to initiate the downward movement of said bucket elevating drive, responsive to a deflection signal from said second detector means to temporarily stop the downward movement of said bucket elevating drive and also to cause the second rotating drive of said bucket tilting drive to initiate said shoveling operation while tilting said bucket forwardly with a given force, responsive to a detection signal from said third detector means to stop the rotation of said second rotating drive in said bucket tilting drive and also to re-initiate the downward movement of said bucket elevating drive followed by the upward movement of the same, responsive to a detection signal from said first detector means to stop the upward movement of said bucket elevating drive and also to cause the second rotating drive of said bucket tilting drive to initiate the retracting movement of said bucket while tilting said bucket backwardly, and responsive to a detection signal from said fourth detector means to stop said retracting movement of said bucket.

* * * * *